US008041046B2

(12) United States Patent
Ohta et al.

(10) Patent No.: US 8,041,046 B2
(45) Date of Patent: Oct. 18, 2011

(54) REVERBERATION ADJUSTING APPARATUS, REVERBERATION ADJUSTING METHOD, REVERBERATION ADJUSTING PROGRAM, RECORDING MEDIUM ON WHICH THE REVERBERATION ADJUSTING PROGRAM IS RECORDED, AND SOUND FIELD CORRECTING SYSTEM

(75) Inventors: Yoshiki Ohta, Tsurugashima (JP); Takashi Mitsuhashi, Tsurugashima (JP); Teruo Baba, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 915 days.

(21) Appl. No.: 11/631,186

(22) PCT Filed: Jun. 29, 2005

(86) PCT No.: PCT/JP2005/012000

§ 371 (c)(1),
(2), (4) Date: Dec. 29, 2006

(87) PCT Pub. No.: WO2006/003957

PCT Pub. Date: Jan. 12, 2006

(65) Prior Publication Data

US 2009/0220100 A1 Sep. 3, 2009

(30) Foreign Application Priority Data

Jun. 30, 2004 (JP) ..... P2004-192798

(51) Int. Cl.
*H03G 3/00* (2006.01)
*H04R 29/00* (2006.01)
*H04B 3/20* (2006.01)

(52) U.S. Cl. ..... 381/66; 381/56; 381/63

(58) Field of Classification Search ..... 381/56, 381/66, 63, 59, 86, 80–81, 97
See application file for complete search history.

(56) References Cited

U.S. PATENT DOCUMENTS

| | | | | |
|---|---|---|---|---|
| 5,491,754 | A * | 2/1996 | Jot et al. | 381/63 |
| 2001/0016047 | A1 * | 8/2001 | Ohta | 381/98 |
| 2003/0121403 | A1 | 7/2003 | Miyagishima et al. | |
| 2003/0159569 | A1 * | 8/2003 | Ohta | 84/630 |
| 2004/0240676 | A1 * | 12/2004 | Hashimoto et al. | 381/56 |

FOREIGN PATENT DOCUMENTS

| | | | |
|---|---|---|---|
| EP | 0 624 947 | A2 | 11/1994 |
| JP | 7-064582 | A | 3/1995 |

(Continued)

*Primary Examiner* — Xu Mei
*Assistant Examiner* — Douglas Suthers
(74) *Attorney, Agent, or Firm* — Sughrue Mion, PLLC

(57) ABSTRACT

The present invention provides a sound field correcting system and a reverberation adjusting apparatus capable of correcting a reverberation time characteristic by an easy operation without setting a complicated parameter. A surround system 100 has a sound reproducing apparatus 120 for adjusting a reverberation component of sound on the basis of a reverberation characteristic of a listening room 10 and amplifying the sound by a speaker system 130; and a microphone 140 for collecting the amplified sound in a specific listening position in the listening room 10. The sound reproducing apparatus 120 includes: a test signal generating device 124 for generating a test signal; a space characteristic analyzer 127 for recognizing an attenuation characteristic indicative of attenuation with time in the listening room on the basis of the obtained amplified test signal, and calculating attenuation time in the listening position of the amplified sound on the basis of the recognized attenuation characteristic; and a signal processor 200 for adjusting the reverberation characteristic of the listening room 10.

9 Claims, 11 Drawing Sheets

FOREIGN PATENT DOCUMENTS

| | | | |
|---|---|---|---|
| JP | 2001-224092 | A | 8/2001 |
| JP | 2003-195859 | A | 7/2003 |
| JP | 2003-255955 | A | 9/2003 |
| JP | 2003-280675 | A | 10/2003 |
| WO | 92/10876 | A1 | 6/1992 |
| WO | 03/107719 | A1 | 12/2003 |

* cited by examiner

FIG.12

| | 500Hz | | 1kHz | | 2kHz | | 4kHz | | 8kHz | | 16kHz | |
|---|---|---|---|---|---|---|---|---|---|---|---|---|
| | G | M | G | M | G | M | G | M | G | M | G | M |
| RT1 | | | | | | | | | | | | |
| RT2 | | | | | | | | | | | | |
| RT3 | | | | | | | | | | | | |
| RT4 | | | | | | | | | | | | |
| RT5 | | | | | | | | | | | | |
| RT6 | | | | | | | | | | | | |
| RT7 | | | | | | | | | | | | |
| : | | | | | | | | | | | | |
| RTn | | | | | | | | | | | | |

REVERBERATION ADJUSTING APPARATUS, REVERBERATION ADJUSTING METHOD, REVERBERATION ADJUSTING PROGRAM, RECORDING MEDIUM ON WHICH THE REVERBERATION ADJUSTING PROGRAM IS RECORDED, AND SOUND FIELD CORRECTING SYSTEM

The entire disclosure of the Japanese Patent Application No. 2004-192798 filed on Jun. 30, 2004 and including the specification, the claims, the drawings and the abstract is incorporated herein by reference in its entirety.

TECHNICAL FIELD

The present invention belongs to a technical field of a reverberation adjusting apparatus and a sound field correcting system capable of correcting reverberation.

BACKGROUND ART

In recent years, at the time of reproducing sound source such as music, a reproducing apparatus such as an AV amplifier that performs correction of a sound field in a sound field space in which the sound source is reproduced is practically used. Recently, attention is being paid to a technique of correcting a reverberation characteristic of sound source on the basis of the characteristics of a sound field space in which sound is reproduced and performing a reverberation control on the sound field space. In particular, as the technique of correcting the reverberation characteristic, there is a known method of performing addition of reverberation and other corrections on each of a high-frequency component and a low-frequency component and correcting a sound field in which reverberation time is not uniform due to the difference between the characteristic of a high frequency and that of a high frequency.

Specifically, such a sound field correcting system for correcting a sound field space adds reverberation time to a high frequency component and adds reverberation to a low frequency component while adjusting amplitude and a phase characteristic by using an FIR filter. By adding the components finally, reverberation time is arbitrarily set for each of the frequency bands. Thus, a sound field having uniform reverberation time characteristic in the frequency bands can be provided (for example, Patent Document 1).

There is another method proposed (for example, Patent Document 2). When an ideal reverberation characteristic for correcting the reverberation characteristic, for example, reverberation time is set at the time of correcting the reverberation characteristic of amplified sound, sound is amplified in a listening room by using an FIR (Finite Impulse Response) filter on the basis of the predetermined reverberation characteristic. The reverberation characteristic of amplified sound obtained in an arbitrary listening position is approximated.

Patent Document 1: Japanese Patent Application Laid-Open (JP-A) No. 7-64582

Patent Document 2: Japanese Patent Application Laid-Open (JP-A) No. 2003-255955

DISCLOSURE OF INVENTION

Problems to be Solved by the Invention

In the conventional sound field correcting system, however, reverberation time has to be set for each of the high frequency and the low frequency. The operation is troublesome and special knowledge is necessary for obtaining a balance between reverberation time at high frequency and reverberation time at low frequency. Consequently, in many case, it is difficult to set the reverberation time in each of the frequency bands. In such a sound field correcting system, even if the high-frequency signal component or low-frequency signal component is adjusted uniformly, uniform reverberation time may not be obtained depending on the characteristics of the sound field space.

On the other hand, in the case of approximating the reverberation characteristic of sound amplified by the FIR filter, a reflected sound pattern approximated to the set reverberation characteristic is calculated and added to reproduction sound, and the resultant sound is amplified in a listening room. However, the FIR filter for generating the reflected sound pattern needs large amount of time for the process of fixing a filter coefficient. For adjustment of the characteristic, it is necessary to set parameters of the number by the number of filter coefficients. Therefore, in the method of approximating the reverberation characteristic of sound amplified by the FIR filter, efficient and effective adjustment cannot be easily made.

The present invention has been achieved in consideration of the above-described problems. An object of the invention is to provide a sound field correcting system and a reverberation adjusting apparatus capable of correcting the reverberation time characteristic by easy operation without setting a complicated parameter.

Means for Solving the Problems

To solve above-mentioned problems, a first aspect of the present invention provides a reverberation adjusting apparatus for adjusting a reverberation component of sound source which is output from a speaker on the basis of a reverberation characteristic of a sound field space in which the sound source is amplified by a speaker, comprising: a first obtaining device for obtaining a sound signal as the sound source; a generating device for generating a test signal used for analyzing a reverberation characteristic of the sound field space as the sound source; an output control device for amplifying at least one of the sound signal and the test signal and outputting the amplified signal from the speaker; a second obtaining device, when the test signal is amplified and the amplified signal is output from the speaker to the sound field space, for obtaining an amplified sound signal indicative of amplified sound in a specific listening position in the sound field space; a recognizing device for recognizing an attenuation characteristic indicative of attenuation with time of the sound field space with respect to the intensity of sound in the listening position of the amplified sound signal on the basis of the obtained amplified sound signal; a calculating device for calculating rate of change indicative of attenuation time in the listening position of the amplified sound and the degree of change in the intensity level of the amplified sound on the basis of the recognized attenuation characteristic; and an adjusting device for adjusting an attenuation characteristic of the test signal to be amplified and output to the speaker on the basis of the calculated rate of change, wherein the adjusting device adjusts the attenuation characteristic of the sound signal obtained as the sound source and to be amplified and output from the speaker on the basis of the attenuation characteristic adjusted on the test signal.

In addition, a tenth aspect of the invention provides a reverberation adjusting method of adjusting a reverberation component of sound source output from a speaker on the basis of a reverberation characteristic of a sound field space in which the sound source is amplified by the speaker, comprising: a first obtaining process of obtaining a sound signal as the sound source; a generating process of generating a test signal used for analyzing a reverberation characteristic of the sound field space as the sound source; an output control process of amplifying at least one of the sound signal and the test signal and outputting the amplified signal from the speaker; a second obtaining process, when the test signal is amplified and the amplified signal is output from the speaker to the sound field space, for obtaining an amplified sound signal indicative of amplified sound in a specific listening position in the sound field space; a recognizing process of recognizing an attenuation characteristic indicative of attenuation with time of the sound field space of intensity of sound in the listening position of the amplified sound signal on the basis of the obtained amplified sound signal; a calculating process of calculating rate of change indicative of attenuation time in the listening position of the amplified sound and the degree of change in the intensity level on the basis of the recognized attenuation characteristic; a first adjusting process of adjusting an attenuation characteristic of the test signal to be amplified and output to the speaker on the basis of the calculated rate of change; and a second adjusting process of adjusting the attenuation characteristic of the sound signal obtained as the sound source and to be amplified and output from the speaker on the basis of the attenuation characteristic adjusted on the test signal in the first adjusting process.

In addition, an eleventh aspect or a twelfth aspect of the invention provides a reverberation adjusting program for adjusting a reverberation component of sound output from a speaker on the basis of a reverberation characteristic of a sound field space in which the sound source is amplified by a speaker, performed by a computer, wherein the program makes the computer function as: a first obtaining device for obtaining a sound signal as the sound source; a generating device for generating a test signal used for analyzing a reverberation characteristic of the sound field space as the sound source; an output control device for amplifying at least one of the sound signal and the test signal and outputting the amplified signal from the speaker; a second obtaining device, when the test signal is amplified and the amplified signal is output from the speaker to the sound field space, for obtaining an amplified sound signal indicative of amplified sound in a specific listening position in the sound field space; a recognizing device for recognizing an attenuation characteristic indicative of attenuation with time of the sound field space on intensity of sound in the listening position of the amplified sound signal on the basis of the obtained amplified sound signal; a calculating device for calculating rate of change indicative of attenuation time in the listening position of the amplified sound and the degree of change in the intensity level on the basis of the recognized attenuation characteristic; a first adjusting device for adjusting an attenuation characteristic of the test signal to be amplified and output to the speaker on the basis of the calculated rate of change; and a second adjusting device for adjusting the attenuation characteristic of the sound signal obtained as the sound source and to be amplified and output from the speaker on the basis of the attenuation characteristic adjusted on the test signal.

In addition, a thirteenth aspect of the invention provides a sound field correcting system for amplifying sound source by a speaker which is set in a sound field space, comprising: a sound reproducing apparatus for adjusting a reverberation component of the sound source on the basis of a reverberation characteristic of the sound field space and amplifying the sound source by the speaker; and a sound collecting device for collecting the amplified sound in a specific listening position in the sound field space when amplified sound is output from the speaker to the sound field space, wherein the sound reproducing apparatus comprises: a first obtaining device for obtaining a sound signal as the sound source; a generating device for generating a test signal used for analyzing a reverberation characteristic of the sound field space as the sound source; an output control device for amplifying at least one of the sound signal and the test signal and outputting the amplified signal from the speaker; a second obtaining device for obtaining an amplified sound signal indicative of amplified sound collected by the sound collecting device; a recognizing device for recognizing an attenuation characteristic indicative of attenuation with time of the sound field space with respect to the intensity of sound in the listening position of the amplified sound signal on the basis of the obtained amplified sound signal; a calculating device for calculating rate of change indicative of attenuation time in the listening position of the amplified sound and the degree of change in the intensity level on the basis of the recognized attenuation characteristic; and an adjusting device for adjusting an attenuation characteristic of the test signal to be amplified and output to the speaker on the basis of the calculated rate of change, and adjusting the attenuation characteristic of a sound signal obtained as the sound source and to be amplified and output from the speaker on the basis of the attenuation characteristic adjusted on the test signal.

BRIEF DESCRIPTION OF THE DRAWINGS

FIG. 12 is a diagram showing a data structure held in a table provided for a signal process controller in the second embodiment.

DESCRIPTION OF REFERENCE NUMERALS

Figure 1:
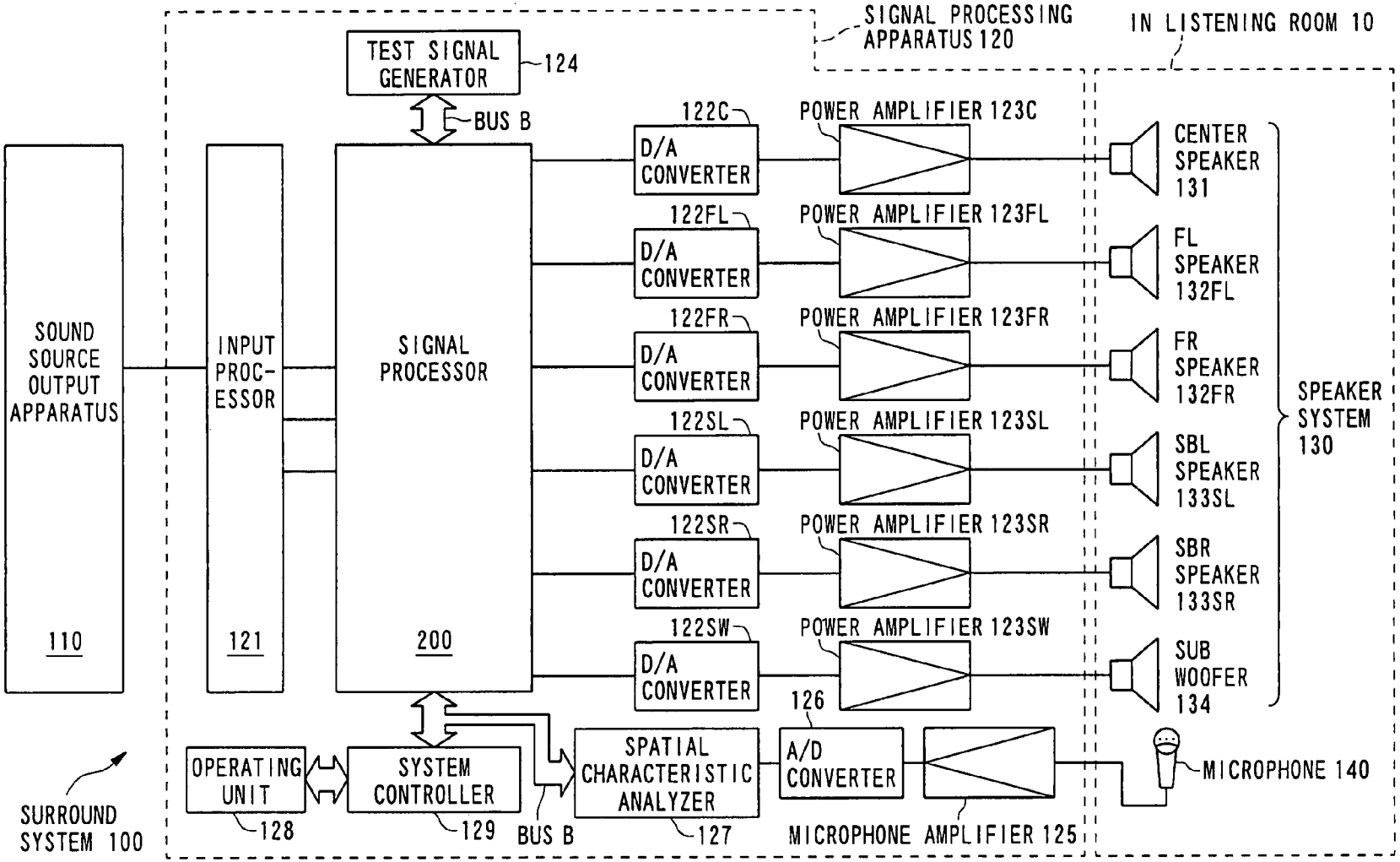
FIG. 1 is a block diagram showing the configuration of a surround system of a first embodiment of the invention.

100 Surround system
120 Signal processor

130 Speaker system
140 Microphone
127 Spatial characteristic analyzer
127C Reverberant characteristic analyzer
128 Operating unit
129 System controller
200 Signal processing unit
250, 350 Reverberation control circuits
251 Filter processing unit
252 Reverberation component generating unit
254, 354 Distributors
255 First generator
256 Second generator
257 First adder
258 Component mix adjuster
259 Second adder
260 Signal process controller
355 First gain adjuster
356 Generator
357 Second gain adjuster
358 Adder

BEST MODE FOR CARRYING OUT THE INVENTION

Preferred embodiments of the invention will now be described based on the drawings.

The embodiments described below relate to the case of applying a reverberation adjusting apparatus or a sound field correcting system of the invention to a 5.1 ch surround system (hereinafter, simply referred to as surround system).

First Embodiment

First, a first embodiment of a surround system according to the invention will be described with reference to FIGS. 1 to 8.

The configuration of the surround system of the embodiment will be described with reference to FIG. 1. FIG. 1 is a block diagram showing the configuration of the surround system of the embodiment.

As shown in FIG. 1, a surround system 100 of the first embodiment is disposed in a listening room 10, that is, a sound field space for providing the listener with reproduction sound. The surround system 100 reproduces or obtains a sound source and performs a predetermined signal process on the reproduced sound or obtained sound. The surround system 100 amplifies the signal-processed sound on the speaker unit basis by a 5.1ch speaker system 130, thereby providing the listener with a sound field space with the presence of a live performance (with surrounding sound).

The surround system 100 is constructed by: a sound source output apparatus 110 for outputting bit stream data of a predetermined format having a channel component corresponding to each speaker by reproducing a sound source such as a recording medium or obtaining a sound source from the outside such as a television signal; a signal processing apparatus 120 for decoding the bit stream output from the sound source output apparatus to an audio signal for each channel, performing a signal process on the audio signal of each channel, and analyzing a reverberation characteristic and the other spatial characteristics of the listening room 10; the speaker system consisted of various speakers corresponding to various channels; and a microphone 140 used at the time of analyzing the spatial characteristics of the listening room 10.

The channels denote transmission paths of the audio signals output to the speakers, and each channel transmits an audio signal basically different from audio signals of the other channels.

For example, the signal processing apparatus 120 of the embodiment corresponds to a reverberation adjusting apparatus of the present invention, the speaker system 130 corresponds to a speaker of the invention, and the microphone 140 corresponds to a sound collecting device of the invention.

The sound source output apparatus 110 is constructed by, for example, an apparatus for reproducing media such as CD (Compact Disc) or DVD (Digital Versatile Disc) or a receiving apparatus for receiving a digital television broadcasting. The sound source output apparatus 110 reproduces a sound source such as CD or obtains a broadcasted sound source and outputs bit stream data having a channel component corresponding to 5.1 ch to the signal processing apparatus 120.

To the signal processing apparatus 120, the bit stream data having channel components output from the sound source output apparatus 110 is input. The signal processing apparatus 120 decodes the input bit stream data to audio signals of the respective channels.

The signal processing apparatus 120 performs:

(1) adjustment of the frequency characteristic of each of the decoded audio signals;

(2) addition of the reverberation component each preset frequency band on each of the decoded audio signals;

(3) adjustment of the signal level and a delay amount in each of the decoded audio signals; and (4) analysis of the spatial characteristics such as the frequency characteristic and the reverberation characteristic in a listening position in the listening room 10, and conversion of the audio signals subjected to the signal process to analog signals, thereby adjusting the sound volume level. The signal processing apparatus 120 outputs the audio signals whose sound volume level has been adjusted to the speakers of the speaker system 130.

The details of the configuration and operation of the signal processing apparatus 120 in the embodiment will be described later.

The speaker system 130 has: a center speaker 131 disposed in front of a listener; a front right speaker (hereinafter, referred to as FR speaker) 132FR and a front left speaker (hereinafter, referred to as FL speaker) 132FL disposed in front of the listener and on the right or left side of the center speaker 131; a right surround speaker (hereinafter, referred to as SR speaker) 133SR and a left surround speaker (hereinafter, referred to as SL speaker) 133SL disposed on the rear side of the listener and on the right and left sides, respectively, of the FR speaker 132FR and the FL speaker 132FL; and a low-frequency reproduction speaker (hereinafter, referred to as sub woofer) 134 disposed in an arbitrary position.

Specifically, the center speaker 131, the FL speaker 132FL, the FR speaker 132FR, the SL speaker 133SL, and the SR speaker 133SR are full-range speakers having the reproducible frequency characteristic in almost the full range of the frequency band used at the time of amplifying an audio signal. Each of the speakers amplifies the audio signals with its radial axis directed to the listening position. The sub woofer 134 is used at the time of amplifying signals in a predetermined low frequency band.

The microphone 140 has the characteristic of omnidirection, is connected to the signal processing apparatus 120, and is disposed in a listening position in which the listener listens to sound. The microphone 140 is used for analyzing the spatial characteristics of the listening room 10 which will be described later. In particular, the microphone 140 of the embodiment collects amplified sound on the basis of a test signal output from the speaker system 130, converts the collected amplified sound to an electric signal, and outputs the electric signal as a collected sound signal (hereinafter, also referred to as amplified sound signal) to the signal processing apparatus 120.

Next, the configuration and operation of the signal processing apparatus 120 of the embodiment will be described.

The signal processing apparatus 120 of the embodiment has, as shown in FIG. 1, an input processor 121 to which bit stream data of a predetermined format having respective channel components is input, and which converts the bit stream data to audio data in a signal format used at the time of decoding to an audio signal of each channel, a signal processor 200 for decoding the converted audio data to an audio signal of each channel and performing a signal process on the channel unit basis, a D/A converter 122 for D/A converting a digital audio signal of each channel to an analog signal, and a power amplifier 123 for amplifying the reproduction level of the signal of each channel on the channel unit basis.

The signal processing apparatus 120 also has a test signal generator 124 for generating a test signal used at the time of analyzing space characteristics of the listening room 10, particularly, a reverberation characteristic in the embodiment, a microphone amplifier 125 for amplifying a signal collected by the microphone 140 to a preset signal level, an A/D converter 126 for performing analog-to-digital (A/D) conversion that converts the amplified sound signal as an analog signal to a digital signal, a space characteristic analyzer 127 for analyzing the space characteristics of the listening room 10 on the basis of the sound collection signal converted to the digital signal, an operating unit 128 for operating each of the components; and a system controller 129 for controlling each of the components on the basis of the operation of the operating unit 128.

For example, the input processor 121 of the embodiment corresponds to a first obtaining device of the invention, and the signal processor 200 corresponds to an adjusting device, a first adjusting device, and a second adjusting device of the invention. For example, the power amplifier 123 of the embodiment corresponds to an output control device of the invention, and the test signal generator 124 corresponds to a generating device of the invention. Further, for example, the spatial characteristic analyzer 127 of the embodiment corresponds to a second obtaining device, an adjusting device, and a calculating device of the invention, and the operating unit 128 corresponds to an operating device of the invention.

To the input processing unit 121, the bit stream data in a predetermined format having channel components is input. The input processing unit 121 converts the input bit stream data to audio data in a predetermined format, and outputs the converted audio data to the signal processor 200.

To the signal processor 200, the audio data output from the input processing unit 121 and the test signal generated by the test signal generator 124 is input. The signal processor 200 decodes the input audio data to audio signals of respective channels, performs a predetermined signal process on the channel unit basis, and outputs the audio signal of each channel to the corresponding D/A converter 122. The signal processor 200 performs a predetermined process for amplifying an input test signal to each of the speakers under control of the system controller 129, and outputs the test signal as an audio signal to each of the D/A converter 122 on the channel unit basis.

Specifically, the signal processor 200 determines a coefficient necessary at the time of respective performing signal processes such as frequency characteristic adjustment, delay time control, signal level control, and reverberation control on an input signal on the basis of the data of parameters output from the spatial characteristic analyzer 127, performs a signal process on the basis of respective determined coefficients, and outputs the resultant to respective D/A converters 122.

The details of the configuration and operation of the signal processor 200 in the embodiment will be described later.

To the D/A converters 122, each of the audio signals subjected to each of the signal processes are input on the channel unit basis. The D/A converters 122 convert each of the audio signals as the input digital signals to analog signals and output the analog signals to the respective power amplifiers 123.

To the power amplifiers 123, the processed audio signals are input on the channel unit basis. Under control of the system controller 129, each of the power amplifiers 123 amplifies the signal level of the audio signal of a corresponding channel on the basis of an instruction of volume designated by the operating unit 128, and outputs the amplified audio signal to each of the speakers corresponding to each of the channels.

The test signal generator 124 generates a test signal used at the time of analyzing the space characteristics such as the reverberation characteristic of the listening room 10, and outputs the generated test signal to the signal processor 200. Specifically, the test signal generator 124 generates a test signal such as sweep signal for sweeping, for example, white noise, pink noise, or frequencies in a predetermined frequency range under control of the system controller 129, and outputs the generated test signal to the signal processor 200.

The test signal generator 124 of the embodiment generates a test signal interlockingly with the signal processor 200 and the space characteristic analyzer 127 under control of the system controller 129, and used at the time of setting a coefficient used at the time of generating a reverberation component (hereinafter, referred to as reverberation control coefficient) in the signal processor 200 which will be described later.

To the microphone amplifier 125, the collected sound signal, which is output from the microphone 140, is input. The microphone amplifier 125 amplifies the input collected sound signal to a preset signal level and outputs the amplified collected sound signal to the A/D converter 126.

The collected sound signal, which is output from the microphone amplifier 125, is input to the A/D converter 126. The A/D converter 126 converts the input collected sound signal as an analog signal to a digital signal, and outputs the digital sound signal to the spatial characteristic analyzer 127.

To the spatial characteristic analyzer 127, the collected sound signal converted to the digital signal is input. On the basis of the input collected sound signal, the spatial characteristic analyzer 127 analyzes the frequency characteristic of the output amplified sound on the channel unit basis, the sound pressure level of the sound, and the reverberation characteristic of the sound. On the basis of the analysis results, the spatial characteristic analyzer 127 controls the signal processor 200 via the system controller 129. In particular, the spatial characteristic analyzer 127 performs the analysis on the basis of the collected sound signal based on the test signal output from the speaker system 130.

The details of the configuration and operation of the spatial characteristic analyzer 127 in the embodiment will be described later.

The operating unit 128 is constructed by a remote controller including a number of keys such as various confirmation buttons, selection buttons, and numeral keys, or various key buttons. In particular, in the embodiment, the operating unit 128 is used to enter an instruction for analysis of the special characteristic in the listening room 10. In particular, the operating unit 128 is used to perform operation related to a setting of reverberation time on an audio signal to be amplified.

The system controller 129 controls, in a centralized manner, the general functions for amplifying the audio signals from each of the speakers. In particular, the system controller 129 has a counter used for processes, controls the components at the time of performing a process for selecting a speaker for amplifying a test signal and calculating a parameter for setting a reverberation control coefficient (hereinafter, referred to as reverberation parameter) for analysis of the reverberation characteristic of the listening room 10 (hereinafter, reverberation parameter calculating process). The system controller 129 also performs a process of setting a reverberation control coefficient at the time of amplifying an audio signal on the basis of the operation of the user, that is, a process of setting a coefficient for performing the reverberation control at the time of amplifying an audio signal (hereinafter, referred to as reverberation control coefficient setting process).

The details of the operations of the reverberation control coefficient setting process including the reverberation parameter calculating process of the system controller 129 in the embodiment will be described hereinafter.

The reverberation characteristic denotes a characteristic showing attenuation with time of the amplitude level (strength) of an amplified sound which is listened in an arbitrary listening position in the listening room 10. Specifically, the reverberation characteristic denotes a characteristic of an amplitude level attenuation ratio using, as reference, time in which reproduction of stationary sound in the listening position from an arbitrary speaker is stopped and the time in each of frequency bands on the basis of the collected-sound signal in an input test signal. In the embodiment, the reverberation characteristic of the listening room is calculated by using, as a gradient of an approximate liner line, the attenuation ratio of an amplitude level and reverberation time in the case of performing logarithm computation on the attenuation ratio of the amplitude level. In addition, the reverberation time, that is, a parameter proportional to a reverberation amount and corresponding to the reverberation time in a one-to-one corresponding time is calculated as a reverberation parameter (which corresponds to $\alpha$ to be described later) on the basis of the gradient of the calculated approximate straight light. As will be described later, the reverberation control coefficient is calculated on the basis of the reverberation parameter. Therefore, in the embodiment, the reverberation component can be adjusted on the basis of the approximate straight line of the calculated reverberation characteristic on the basis of the reverberation parameter.

Figure 2:
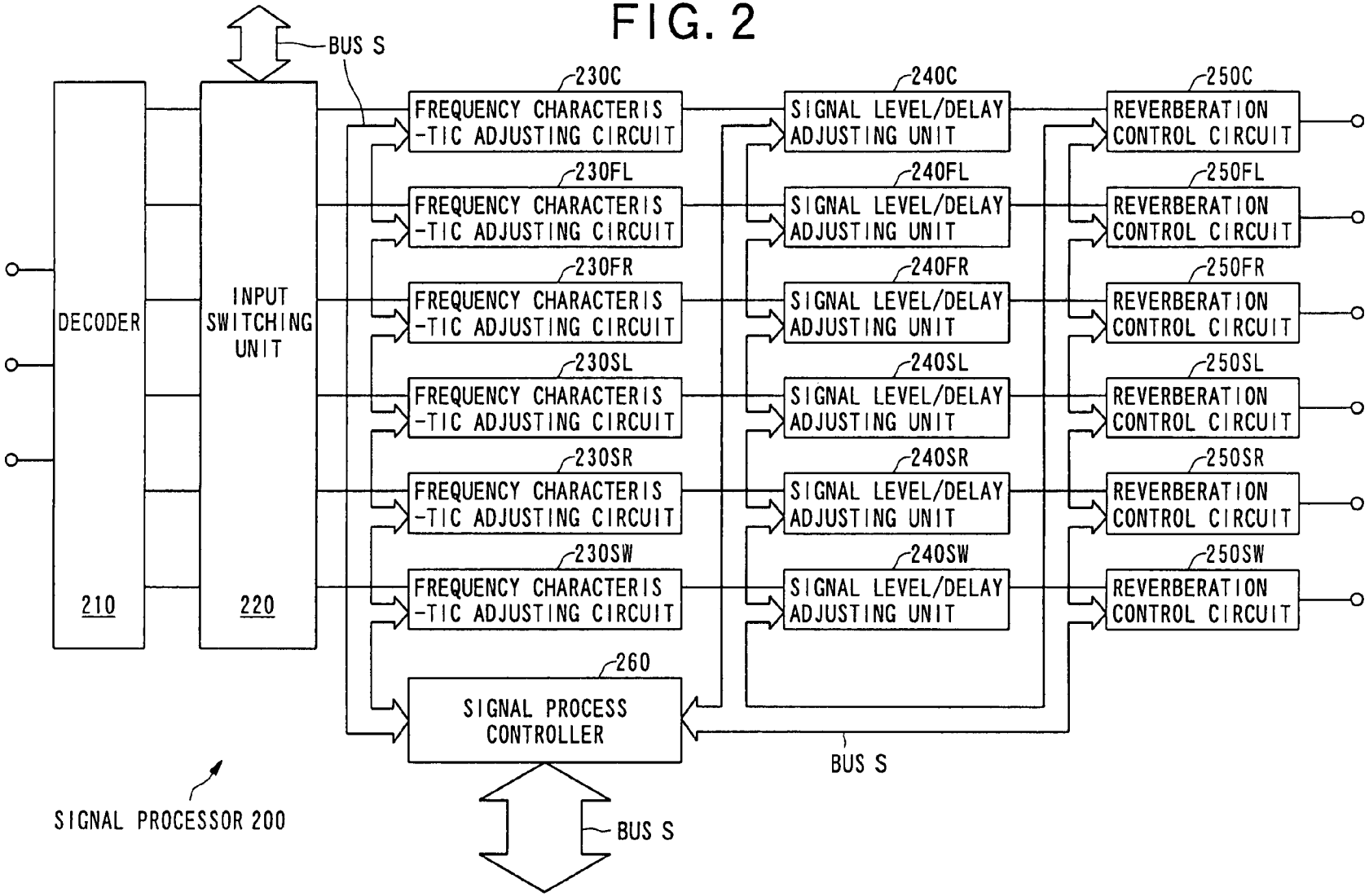
FIG. 2 is a block diagram showing the configuration of a signal processing unit in the first embodiment.

Referring now to FIG. 2, the configuration and operation of the signal processor 200 of the embodiment will now be described with reference to FIG. 2. FIG. 2 is a block diagram showing the configuration of the signal processor 200 in the embodiment.

The signal processor 200 decodes input audio data to an audio signal of each channel, and switches entry between the decoded audio signal of each channel and a test signal output from the test signal generator 124. The signal processor 200 performs a predetermined signal process on the channel unit basis on an input signal, and performs a predetermined process for amplifying an input test signal on the speaker unit basis under control of the system controller 129.

Specifically, the signal processor 200 has: a decoder 210 for decoding input audio data to audio signals in channels; an input switching unit 220 for switching between the audio signals in each of the channels obtained from the data and an input test signal; a frequency characteristic adjusting circuit 230 for adjusting the frequency characteristics of the audio signals in each of the channels or the test signal; a signal level/delay adjusting unit 240 for adjusting the signal level between the channel of a signal and the other channels and delaying a signal input on the channel unit basis; a reverberation control circuit 250 for generating a reverberation component of an audio signal of each channel or the test signal on the basis of a reverberation control coefficient which is set as will be described later and adding the reverberation component to the audio signal or the test signal; and a signal process controller 260 for controlling each of the components of the signal processor 200 under control of the system controller 129.

The signal processor 200 has the frequency characteristic adjusting circuit 230, the signal level/delay adjusting unit 240, and the reverberation control circuit 250 for each of the channels, and the signal process controller 260 and the other components are connected to each other via a bus B.

Audio data is input to the decoder 210. The decoder 210 decodes the input audio data to audio signals of respective channels, and outputs the audio signals to the input switching unit 220 on the channel unit basis.

To the input switching unit 220, the audio signals decoded on the channel unit basis and a test signal output from the test signal generator 124 are input. Under control of the signal process controller 260, the input switching unit 220 switches between the audio signal output from the decoder 210 and the test signal generated by the test signal generator 124 under control of the signal process controller 260, and outputs the switched signal to the frequency characteristic adjusting circuits 240. At the time of outputting a test signal, the input switching unit 220 outputs the test signal to the channels or one of respective channels selected by the signal process controller 260.

In each of the frequency characteristic adjusting circuits 230, a filter factor for adjusting the gain of a signal component is set on the frequency band unit basis under control of the signal process controller 260. To each of the frequency characteristic adjusting circuit 230, an input audio signal of each channel or a test signal is input. The frequency characteristic adjusting circuit 230 adjusts the frequency characteristic on the input signal on the basis of the set filter factor, and outputs the adjusted frequency characteristic to the corresponding signal level/delay adjusting unit 240.

In each of the signal level/delay adjusting units 240, under control of the signal process controller 260, a coefficient for adjusting the attenuation ratio in each of the channels (hereinafter, referred to as an attenuation coefficient) in each channel and a coefficient for adjusting a delay amount (delay time) in the audio signal corresponding to the channel or the test signal (hereinafter, referred to as delay control coefficient) are set. To each of the signal level/delay adjusting units 240, the audio signal whose frequency characteristic is adjusted in each of the frequency bands or the test signal is input. Each of the signal level/delay adjusting units 240 adjusts the attenuation ratio and the delay amount each of the channels in the input signal on the basis of the set attenuation coefficient and the delay control coefficient, and outputs the audio signal or test signal in which the attenuation coefficient and the delay amount are adjusted to the corresponding reverberation control circuit 250.

In each of the reverberation control circuit 250, a reverberation control coefficient determined by the signal process controller 260 as will be described later. Each of the reverberation control circuits 250 executes a reverberation control on the audio signal or test signal subjected to the signal level adjustment, and outputs the resultant signal to each of the D/A converters 122.

Specifically, to each of the reverberation control circuits 250, the audio signal or test signal whose signal level and delay amount are adjusted are input. Each of the reverberation control circuits 250 divides the audio signals or test signals input on the channel unit basis to a plurality of frequency bands. Each of the reverberation control circuits 250 performs the reverberation control by generating the reverberation components in each of the frequency bands in the input audio signal or test signal input on the basis of the reverberation control coefficient which will be described later, and adding the generated reverberation component to the input audio signal or test signal, and outputs the signal subjected to the reverberation control to each of the D/A converters 122.

The details of the configuration and operation of the reverberation control circuit 250 in the embodiment will be described later. For example, the reverberation control circuit 250 of the embodiment corresponds to an adjusting unit, a generating unit, and a reverberation adjusting unit of the invention.

In response to an instruction of the system controller 129, the signal process controller 260 determines and sets coefficients of each of the frequency characteristic adjusting circuits 230, each of the signal level/adjustment adjusting units 240, and each of the reverberation control circuits 250. Particularly, the signal process controller 260 calculates a filter factor, an attenuation coefficient, and a delay control coefficient on the basis of data of each of the parameters analyzed by the spatial characteristic analyzer 127 and also calculates the reverberation control coefficient for performing control of generation of each of the reverberation components in the reverberation control circuits 250 on the basis of the reverberation parameters. The signal process controller 260 sets the calculated reverberation control coefficients in each of the reverberation control circuits 250.

Specifically, when the reverberation control coefficient setting process is performed, the signal process controller 260 obtains the reverberation parameters in each of the channels and the frequency bands calculated in the space characteristic analyzer 127 as will be described later. On the basis of the obtained reverberation parameters, the signal process controller 260 calculates the reverberation control coefficient for each of the frequency bands, and sets the calculated reverberation control coefficient in each of the reverberation control circuits 250.

For example, the signal process controller 260 of the embodiment calculates reverberation control coefficients g1 and g2 corresponding to the reverberation amounts each indicative of the reverberation time in a one-to-one corresponding manner in each of the reverberation control circuits 250 and in each of the frequency bands.

When the reverberation parameter is $\alpha$, the parameter g1 is calculated as $g1=\alpha^{(m1)}$. The parameter g1 is a value satisfying $g1<1$, and the parameter (m1) is a predetermined natural number. Although it is desirable to use, as (m1), a value which varies each of the reverberation control circuits 250 and each of the frequency bands, the same value in the reverberation control circuits 250 or in the frequency bands may be used. On the other hand, when the reverberation parameter is $\alpha$, the parameter g2 is calculated as $g2=\alpha^{(m2)}$ in a manner similar to the parameter g1. The parameter g2 is a value satisfying $g2<1$, and the parameter (m2) is a predetermined natural number. Although it is desirable to use, as (m2), a value which varies each of the reverberation control circuits 250 and each of the frequency bands, the same value in each of the reverberation control circuits 250 or in each of the frequency bands may be used In the embodiment, the reverberation control coefficient in each of the frequency bands of each of the reverberation control circuits 250 can be set on the basis of the reverberation parameter as described above. Therefore, since the reverberation parameter corresponds to the gradient of an approximate linear line indicative of the reverberation characteristic of the listening room 10, each of the reverberation control coefficients can be calculated and set on the basis of the gradient of the approximate linear line.

Figure 3:
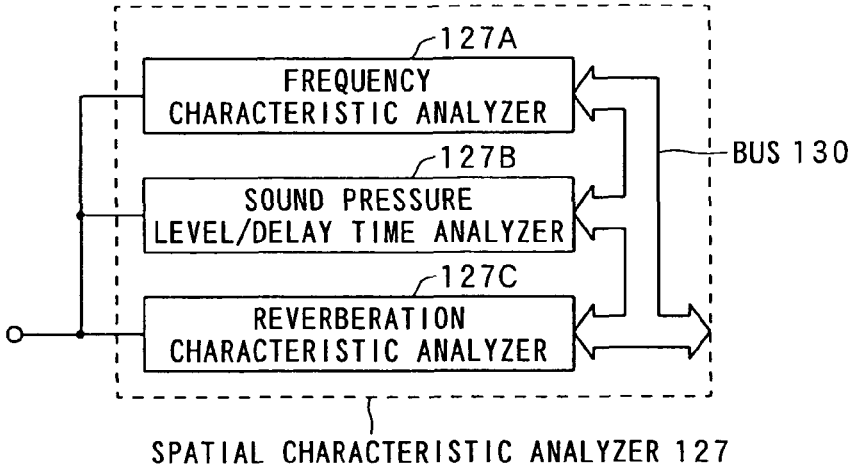
FIG. 3 is a block diagram showing the configuration of a spatial characteristic analyzer in the first embodiment.
Figure 4:
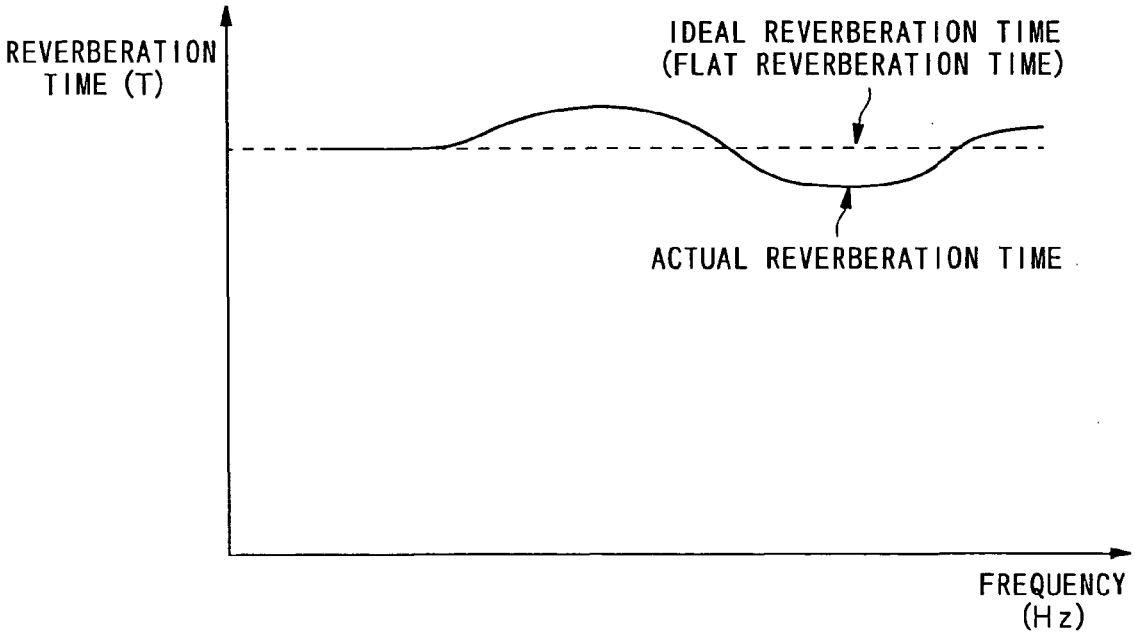
FIG. 4 is a diagram (I) for explaining reverberation parameter calculating process in a reverberation characteristic analyzer in the first embodiment.
Figure 5B:
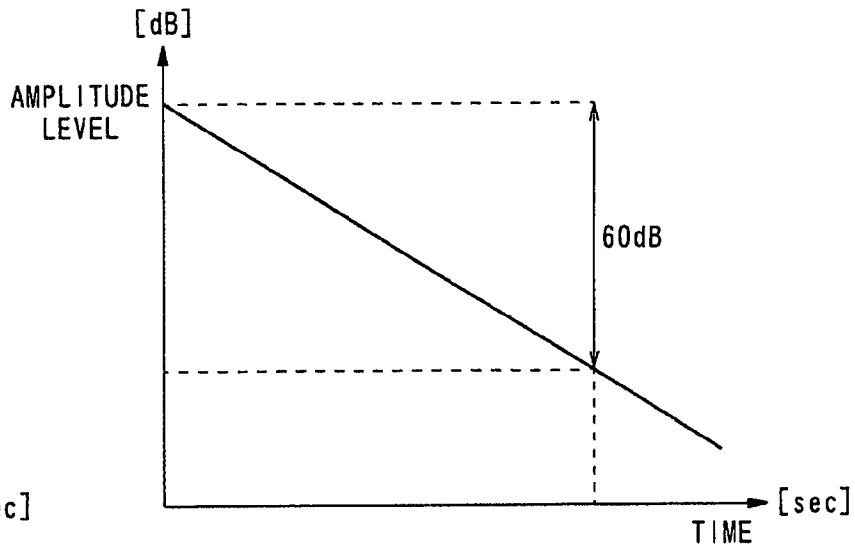
FIGS. 5A and 5B are graphs each showing the amplitude level ratio of the reverberation characteristic and reverberation time in the reverberation characteristic analyzer in the first embodiment.

The configuration and operation of the spatial characteristic analyzer 127 in the embodiment will be described with reference to FIGS. 3 to 6. FIG. 3 is a block diagram showing the configuration of the spatial characteristic analyzer 127 in the embodiment, and FIGS. 4 to 6 are diagrams for explaining calculation of reverberation time in a reverberation characteristic analyzer 127C in the embodiment.

To the spatial characteristic analyzer 127, a collected-sound signal generated by collecting a sound amplified on the basis of a test signal is input. As described above, on the basis of the input sound-collected signal, the spatial characteristic analyzer 127 performs analysis of the frequency characteristic of the amplified sound output on the channel unit basis, analysis of the sound pressure level of the amplified sound, delay time analysis, and analysis of the reverberation component of the amplified sound. On the basis of results of the analysis, the spatial characteristic analyzer 127 outputs data to the signal processor 200 via the system controller 129.

The spatial characteristic analyze 127 includes: a frequency characteristic analyzer 127A for analyzing the frequency characteristic of the listening room 10; a sound pressure level/delay time analyzer 127B for analyzing the sound pressure level and delay time of amplified sound from each of the speakers in the listening room 10; and the reverberation characteristic analyzer 127C for analyzing the reverberation characteristic of the listening room 10 and calculating the reverberation parameter when the reverberation control coefficient setting process is executed.

The frequency characteristic analyzer 127A analyzes the frequency characteristic in the disposed position (listening position) of the microphone 140 in the listening room 10 on the basis of the collected-sound signal in an input test signal, and outputs the result of analysis as data of a predetermined parameter to the signal process controller 260 via the system controller 129. The sound pressure level/delay time analyzer 127B analyzes the sound pressure level and the delay time of amplified sound from each of the speakers in the disposed position of the microphone 140 in the listening room 10. The sound pressure level/delay time analyzer 127B outputs the analysis result as data of the predetermined parameter to the signal process controller 260 via the system controller 129.

The reverberation characteristic analyzer 127C analyzes the reverberation characteristic in the listening room 10 on the basis of the collected-sound signal in the input test signal when the reverberation control coefficient setting process is executed. The reverberation characteristic analyzer 127C determines the reverberation parameter used at the time of determining the reverberation control coefficient determined by the signal process controller 260, and outputs the determined reverberation parameter as data to the signal process controller 260.

Usually, when the reverberation characteristic in the listening room 10 is analyzed, the structural characteristics and spatial environments of the listening room 10 such as the shape of the listening room 10, the material of the wall surface, and furniture existing in the listening room 10. Consequently, the reverberation time at each frequency is often uninformed in the sound collection position, that is, the disposed position of the microphone 140. For example, as shown in FIG. 4, when the axis of abscissa indicates frequency, and the axis of ordinate indicates reverberation time, the reverberation time varies each of the frequencies. With the characteristic such that the reverberation time varies each of the frequencies, the listening (user) feels that the sound is strange.

In the embodiment, to make the signal process controller 260 determine the reverberation control coefficient used at the time of generating the reverberation time in the reverberation control circuit 250, the reverberation characteristic analyzer 127C determines the reverberation parameter on the basis of reverberation time calculated on the basis of the analysis result (hereinafter, also referred to as calculated reverberation time) and reverberation time desired by the user, which is preliminarily set via the operating unit 128 (hereinafter, also referred to as target reverberation time), and outputs the reverberation parameter to the signal control processor 260.

Specifically, first, the reverberation characteristic analyzer 127C calculates reverberation time indicative of the attenuation ratio of an amplitude level and time by using, as reference, time in which reproduction of stationary sound in the listening position from an arbitrary speaker is stopped in each of frequency bands on the basis of the collected-sound signal in an input test signal.

Figure 5A:
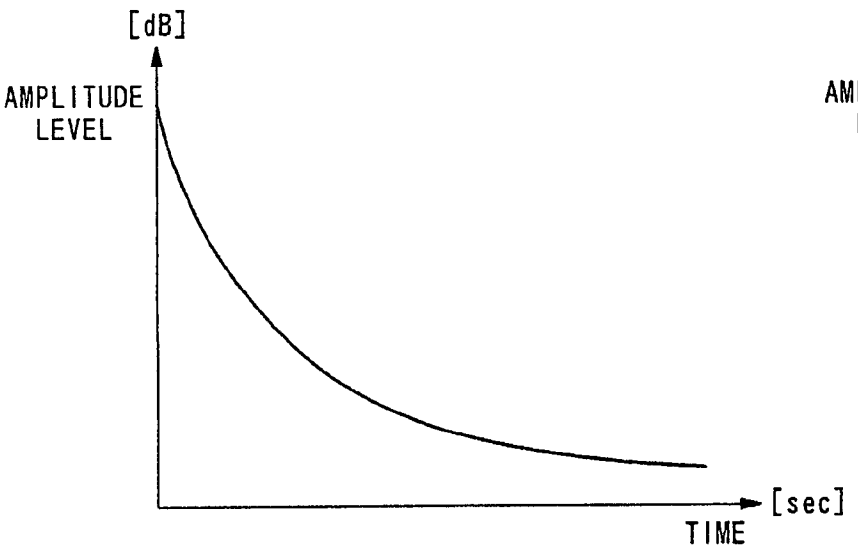
Figure 6:
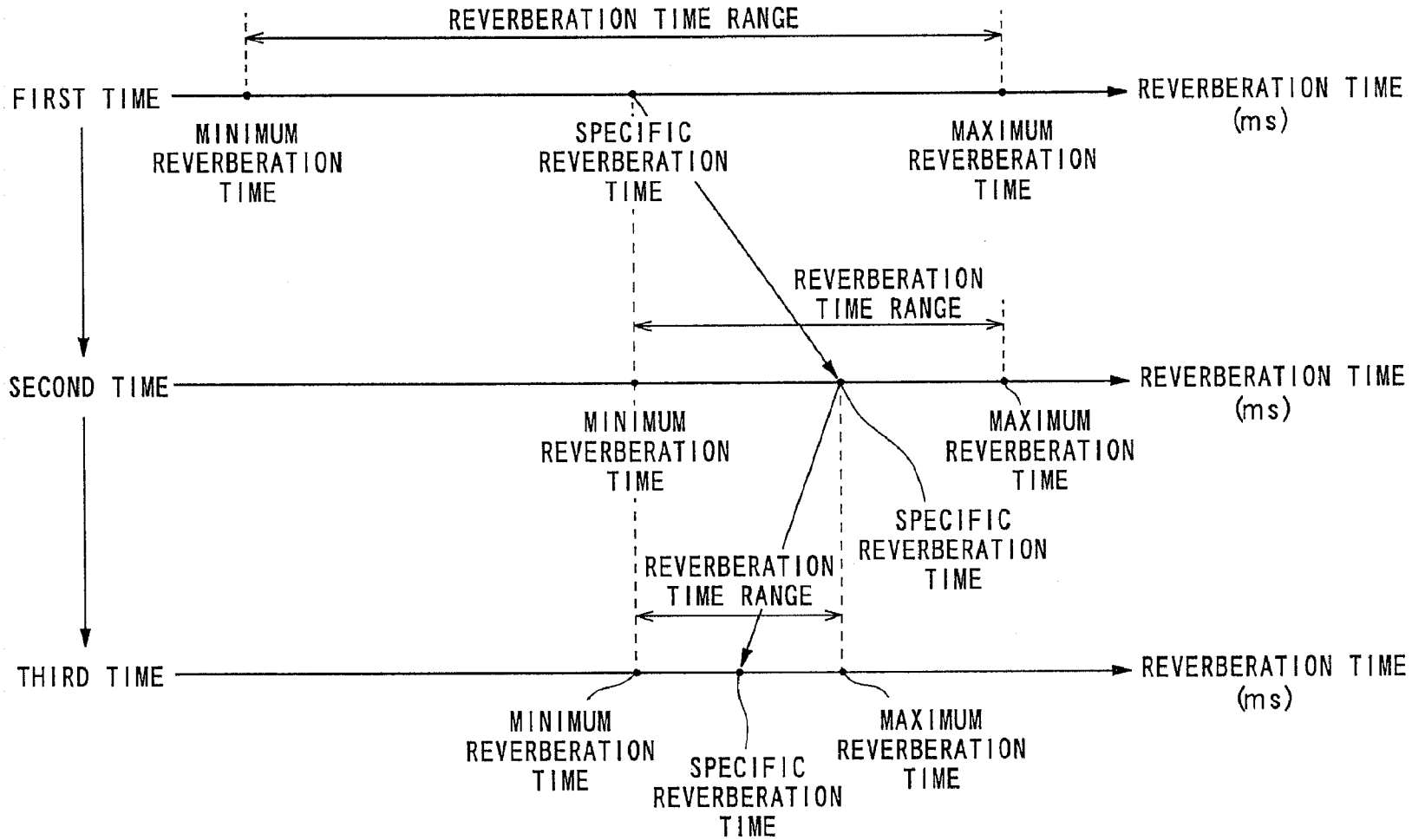
FIG. 6 is a diagram (II) for explaining reverberation parameter calculating process in the reverberation characteristic analyzer in the first embodiment.

For example, in the case of using an impulse signal as the test signal, the reverberation characteristic analyzer 127C of the embodiment calculates an attenuation curve indicative of the relationship between the attenuation ratio of the amplitude level and the reverberation time as shown in FIG. 5A on the basis of the collected-sound signal in the input test signal, and calculates the time when the amplitude level becomes a predetermined level as the reverberation time.

Generally, the reverberation time indicates time in which the sound pressure level when reproduction of stationary sound is stopped is attenuated by 60 dB. The reverberation characteristic analyzer 127C of the embodiment calculates the reverberation time. The reverberation characteristic analyzer 127C of the embodiment calculates the attenuation curve by averaging the time characteristics of the attenuation ratios of the amplitude levels obtained in the respective frequency bands, in each of the frequency bands. Further, in the embodiment, the reverberation characteristic analyzer 127C displays the amplitude level of the attenuation curve in logarithm (dB) and approximates it by straight line, thereby calculating time required to attenuate the sound pressure level by 60 dB. In the embodiment, time required to attenuate the amplitude level by 60 dB, which is calculated by approximating the amplitude level of the attenuation curve displayed in logarithm by straight line is used as reverberation time.

Subsequently, the reverberation characteristic analyzer 127C of the embodiment compares the calculated reverberation time which is calculated on the basis of the collected-sound signal with target reverberation time and, on the basis of the comparison result, determines the reverberation time used at the time of generating the reverberation time in the reverberation control circuit 250. The reverberation characteristic analyzer 127C outputs the determined reverberation time as a reverberation parameter to the signal process controller 260 on the basis of the determined reverberation time. That is, the reverberation characteristic analyzer 127C of the embodiment calculates a reverberation parameter (which corresponds to $\alpha$ to be described later) corresponding to the determined reverberation time in a one-to-one corresponding manner.

More specifically, in the reverberation characteristic analyzer 127C of the embodiment, a range of reverberation time (hereinafter, referred to as reverberation time range) expected to be set as target reverberation time is preliminarily internally set. As will be described later, the reverberation characteristic analyzer 127C determines reverberation time a plurality of times as the determined reverberation time, which lies in the set reverberation time range in the reverberation control coefficient setting process performed once interlockingly with the signal process controller 260 and each of the reverberation control circuits 250. The reverberation characteristic analyzer 127C outputs the reverberation parameter corresponding to each determined reverberation time to the signal processing controller 260. That is, when the reverberation control coefficient in the reverberation control circuit 250 is newly set, the reverberation characteristic analyzer 127C calculates reverberation time on the basis of the analyzed reverberation characteristic of the listening room 10. When the calculated reverberation time and the target reverberation time are different from each other, the reverberation characteristic analyzer 127C outputs a reverberation parameter for changing the reverberation control coefficient in the reverberation control circuit 250. When the reverberation time calculated on the basis of the calculated reverberation characteristic of the listening room 10 and the target reverberation characteristic become sufficiently close to each other in the end, for example, when the calculated reverberation time belongs to the preset range of the target time, the reverberation characteristic analyzer 127C finishes the analysis of the reverberation characteristic of the listening room 10.

For example, in the embodiment, when the reverberation control coefficient setting process is executed, the reverberation characteristic analyzer 127C calculates a reverberation parameter interlockingly with the signal process controller 260 and the reverberation control circuits 250 as described below.

(Reverberation Parameter Calculating Process)

(1) First, when the reverberation control coefficient setting process is started, the reverberation characteristic analyzer 127C determines a reverberation parameter on the basis of the initial value and outputs the determined reverberation parameter to the signal process controller 260.

For example, when the reverberation time range is preliminarily set as 0 ms to 500 ms, the reverberation characteristic analyzer 127C calculates the reverberation parameter corresponding to reverberation time 250 ms as reverberation time at the middle as an initial value, and outputs the calculated reverberation parameter as data to the signal process controller 260.

The system controller 129 controls the signal process controller 260 to determine the reverberation control coefficient in the output reverberation parameter, and sets the determined reverberation control coefficient in each of the reverberation control circuits 250.

(2) Subsequently, under control of the system controller 129, the reverberation characteristic analyzer 127C obtains a collected-sound signal in the test signal, that is, a collected-sound signal amplified on the basis of the reverberation control coefficient which is set for each of predetermined frequency bands and collected by the microphone 140, and analyzes the reverberation characteristic in each of the frequency bands on the basis of the obtained collected-sound signal.

(3) After that, the reverberation characteristic analyzer 127C calculates the reverberation time on the basis of the analyzed reverberation characteristic. Specifically, the reverberation characteristic analyzer 127C calculates, as calculation reverberation time, time in which the sound pressure level when reproduction of stationary sound is stopped is attenuated by 60 dB in each of the frequency bands.

(4) The reverberation characteristic analyzer 127C compares the calculated reverberation time with the target reverberation time which is preset by the operating unit 128 or the like, thereby calculating error time.

For example, the reverberation characteristic analyzer 127C calculates error time for each of the signal components by subtracting the calculated reverberation time from the corresponding target reverberation time.

(5) Subsequently, the reverberation characteristic analyzer 127C newly determines reverberation time used when the reverberation component is added in each of the reverberation control circuits 250 on the basis of the calculated error time.

For example, the reverberation characteristic analyzer 127C of the embodiment determines reverberation time by using error time "0" as a reference as shown in FIG. 6. In the case where it is determined that the calculated error time is "0" or less, the reverberation characteristic analyzer 127C calculates the minimum reverberation time in the reverberation time range on the basis of Equation (1), and calculates one reverberation time (hereinafter, referred to as specific reverberation time) on the basis of Equation (2) by using the calculated minimum reverberation time and the maximum reverberation time in the reverberation time range.

Minimum reverberation time=(specific reverberation time before calculation) Equation (1)

Specific reverberation time=(maximum reverberation time+minimum reverberation time)/2 Equation (2)

On the other hand, in the case where the reverberation characteristic analyzer 127C determines that the calculated error time is greater than "0", the reverberation characteristic analyzer 127C calculates the maximum reverberation time in the reverberation time range on the basis of Equation (3), and calculates a specific reverberation time on the basis of Equation (2) by using the calculated maximum reverberation time and the minimum reverberation time.

Maximum reverberation time=(specific reverberation time before calculation) Equation (3)

(6) The reverberation characteristic analyzer 127C outputs a reverberation parameter preliminarily associated with the newly determined reverberation time to the signal process controller 260.

The system controller 129 makes the signal process controller 260 determine a reverberation control coefficient and set the reverberation control coefficient in the reverberation control circuit 250 on the basis of the reverberation parameter. After the setting, the system controller 129 makes the test signal generator 124 generate a test signal. In such a manner, the reverberation characteristic analyzer 127C repeats the processes (2) to (5) a plurality of times, outputs the reverberation parameter with which the error time becomes "0" finally to the signal process controller 260, and outputs a message indicative of the fact to the system controller 129.

For example, as shown in FIG. 6, the reverberation characteristic analyzer 127C sets the minimum reverberation time, the maximum reverberation time, and the specific reverberation time while repeating the processes (2) to (4) a plurality of times. In the embodiment, the reverberation characteristic analyzer 127C calculates the characteristic reverberation time after repeating the processes ten times as final reverberation time.

When the reverberation characteristic analyzer 127C outputs the calculated reverberation control coefficient as reverberation control coefficient data to the signal process controller 260, the signal process controller 260 sets the reverberation control coefficient data as a reverberation control coefficient of the frequency band corresponding to the corresponding reverberation control circuit 250. After setting of a new reverberation control coefficient by the system controller 129 and the signal process controller 260, the system controller 129 amplifies a test signal of the same channel and makes the reverberation characteristic analyzer 127C execute the reverberation parameter calculating process. Until the error time in each of the frequency bands becomes sufficiently small, for example, until it becomes smaller than a predetermined value, the process of calculating the reverberation control coefficient is repeated.

Figure 7:
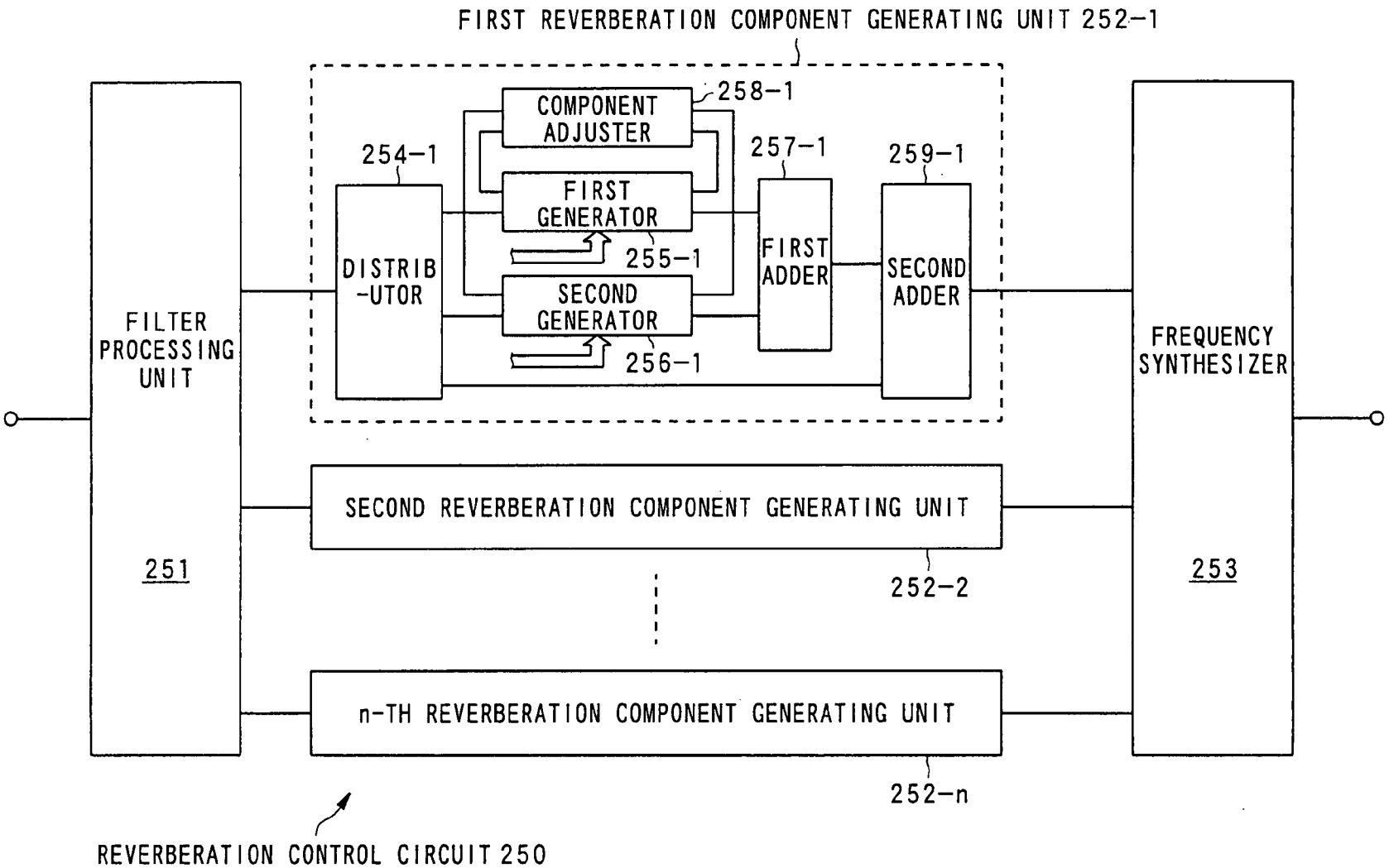
FIG. 7 is a block diagram showing the configuration of a reverberation control circuit of the signal processing unit in the first embodiment.

The configuration and operation of the reverberation control circuit 250 in the embodiment will now be described with reference to FIG. 7. FIG. 7 is a block diagram showing the configuration of the reverberation control circuit 250 in the signal processing unit 200 in the embodiment. The reverberation control circuits 250 in the embodiment have similar configurations.

To each of the reverberation control circuits 250, the audio signal or test signal of a channel subjected to the adjustment of the signal level and delay amount is input. When the audio signal or test signal is input, the reverberation control circuit 250 divides the input audio signal or test signal in a plurality of frequency bands, and generates a reverberation components in each of the frequency bands on the input audio signal or test signal which is input on the basis of the reverberation control coefficient set by the signal process controller 260. The reverberation control circuit 250 performs the reverberation control by adding the generated reverberation component to the input audio signal or test signal, and outputs the signal subjected to the reverberation control to each of the D/A converters 122.

When the reverberation control coefficient setting process is executed, the reverberation control coefficient calculated as described above is set in each of the reverberation control circuits 250 by the signal process controller 260 under control of the signal process controller 260.

Specifically, the reverberation control circuit 250 has: a filter processing unit 251 for dividing the input audio signal or test signal into predetermined frequency bands as shown in FIG. 6; a reverberation component generating unit 252 in which the reverberation control coefficient is set by the signal process controller 260 at the time of the reverberation control coefficient setting process, and which generates the reverberation component for each of the frequency bands divided on the basis of the set reverberation control coefficient, and adds the generated reverberation component to the input original audio signal or test signal; and a frequency synthesizer 253 for synthesizing the audio signal or test signal to which the reverberation component is added in each of the frequency bands.

The reverberation control coefficient set in the reverberation component generating unit 252 is set for each of the channels and each of the frequencies.

To the filter processing unit 251, an audio signal or test signal in one channel output from the signal level/delay adjusting unit 240 connected to the filter processing unit 251 is input. When the audio signal or test signal in one channel is received, the filter processing unit 251 divides the input audio signal or test signal to signal components of the predetermined frequency bands, and outputs the divided signal components to the respective reverberation component generating units 252.

Specifically, like the reverberation characteristic analyzer 127C, the filter processing unit 251 of the embodiment divides the input audio signal or test signal to the frequency bands similar to the frequency bands of the calculated reverberation control coefficient. For example, the filter processing unit 251 divides the input audio signal or test signal into frequency bands using, as a center frequency, each of 500 Hz, 1 kHz, 2 kHz, 4 kHz, 8 kHz, and 16 kHz, and outputs the divided signal components to the reverberation component generating units 252.

In each of the reverberation component generating units 252, when the reverberation control coefficient setting process is executed, a reverberation control coefficient corresponding to the reverberation component generating unit 252 is set by the signal process controller 260. When one signal component in the audio signal or test signal is input to the reverberation control circuit 250, the reverberation component generating unit 252 generates a reverberation component on the basis of the reverberation control component set for the signal component, adds the generated reverberation component to the original signal component, and outputs the resultant component to the frequency synthesizer 253.

Specifically, each of the reverberation component generating unit 252 has: a distributor 254 for dividing the input audio signal or test signal to a plurality of frequency band components which are preliminarily determined for the respective frequency bands; a first generator 255 in which the reverberation control coefficient is set at the time of performing the reverberation control coefficient setting process and which generates a first reverberation component for one of the components distributed on the basis of the set reverberation control coefficients in the case where the audio signal or test signal is input; a second generator 256 in which the reverberation control coefficient is set at the time of performing the reverberation control coefficient setting process and which generates a second reverberation component for one of the components distributed on the basis of the set reverberation control coefficients in the case where the audio signal or test signal is input; a first adder 257 for adding the first and second reverberation components in the case where the audio signal or test signal is input; a component mix adjuster 258 for generating a reverberation component to be fed back to the first and second generators 255 and 256 (hereinafter, referred to as feedback reverberation components) on the basis of the first and second feedback components; and a second adder 259 for adding an output of the first adder 257 and a signal component (hereinafter, referred to as main component) directly output from the distributor 254.

Although the first reverberation component generating unit 252-1 to the n-th reverberation component generating unit **252-*n* for different frequency bands are shown as the reverberation component generating units 252 in FIG. 7, for example, in the embodiment, the first reverberation component generating unit 252 to the sixth reverberation component generating unit 252** are provided in increasing order of the frequency bands having, as the center frequency, 500 Hz, 1 kHz, 2 kHz, 4 kHz, 8 kHz, and 16 kHz, respectively.

For example, the reverberation component generating unit 252 of the embodiment corresponds to an adjusting device of the invention. The first generator 255, the second generator 256, and the component mix adjuster 258 corresponds to a generating device and a reverberation adjusting device of the invention.

When one signal component in the audio signal or test signal is input to the reverberation control circuit 250, the corresponding one signal component output from the filter processing unit 251 is input to the distributors 254. Each of the distributors 254 distributes the input signal component to the first generator 255, the second generator 256, and the second adder 259.

Specifically, when one signal component in the audio signal or test signal is input to the reverberation control circuit 250, each of the distributor 254 multiplies the input signal component with different coefficients, thereby generating a first signal component and a second signal component, and outputs the first and second signal components to the first and second generators 255 and 256, respectively. The distributor 254 directly outputs the signal component as it is to the second adder 259.

Each of the distributors 254 multiplies the signal component to be distributed for performing feedback compensation at the time of generating a reverberation component in the first and second generators 255 and 256 with preset coefficients b1 and b2 (hereinafter, referred to as initial coefficients).

In the first generator 255, when the reverberation control coefficient setting process is executed, a reverberation control coefficient corresponding to the frequency band in the reverberation control circuit 250 is set by the signal process controller 260. For example, the reverberation control coefficient is set in a memory (not shown) provided on the inside of the first generator 255.

When one signal component in the audio signal or test signal is input to the reverberation control circuit 250, the first signal component output from the distributor 254 and multiplied with the initial coefficient and a feedback reverberation component output from the component mix adjuster 258 and having predetermined delay time are input to the first generator 255. The first generator 255 adds the feedback reverberation component having the predetermined delay time to the input first signal component, generates a reverberation component having the predetermined delay time in the added first signal component on the basis of the set reverberation control coefficient, and outputs the generated reverberation component as the first reverberation component to the first adder 257 and the component mix adjuster 258.

For example, when one signal component in the audio signal or test signal is input to the reverberation control circuit 250, the first generator 255 performs computation shown by Equation (4) on the first signal component on the basis of the reverberation control coefficient set in the internal memory, thereby generating the first reverberation component. The first generator 255 outputs the generated first reverberation component to the first adder 257 and the component mix adjuster 258.

$$\text{First reverberation component} = (\text{first signal component}) \times Z^{(-m1)} \times g1 \qquad \text{Equation (4)}$$

As described above, the parameter g1 is one of reverberation control coefficients calculated and set by the signal process controller 260. (m1) is, desirably, a value which varies each of the reverberation control circuits 250 and the first generators 255 but may be the same value in the reverberation control circuits 250 or the first generators 255.

The first reverberation component generated by the first generator 255 is set so that as the parameter α increases, the reverberation time increases and, as the parameter α decreases, the reverberation time decreases as shown by Equation (4). The feedback reverberation component output from the component mix adjuster 258 and having the predetermined delay time is a reverberation component in which the first and second reverberation components are mixed as will be described later.

In the second generator 256, like in the first generator 255, when the reverberation control coefficient setting process is executed, a reverberation control coefficient corresponding to the frequency band in the reverberation control circuit 250 is set by the signal process controller 260. For example, in the embodiment, the reverberation control coefficient is set in a memory (not shown) provided on the inside of the second generator 256.

When one signal component in the audio signal or test signal is input to the reverberation control circuit 250, the second signal component output from the distributor 254 and multiplied with the initial coefficient and a feedback reverberation component output from the component mix adjuster 258 and having predetermined delay time as will be described later are input to the second generator 256. The second generator 256 adds the feedback reverberation component having the predetermined delay time to the input second signal component, generates a reverberation component having the predetermined delay time in the added first signal component on the basis of the set reverberation control coefficient, and outputs the generated reverberation component as the second reverberation component to the first adder 257 and the component mix adjuster 258.

For example, when one signal component in the audio signal or test signal is input to the reverberation control circuit 250, the second generator 256 performs computation shown by Equation (5) on the second signal component on the basis of the reverberation control coefficient set in the internal memory, thereby generating the second reverberation component. The second generator 256 outputs the generated second reverberation component to the first adder 257 and the component mix adjuster 258.

$$\text{Second reverberation component}=(\text{second signal component})\times Z^{(-m2)}\times g2 \qquad \text{Equation (5)}$$

The parameter g2 is one of reverberation control coefficients calculated and set by the signal process controller 260 like the parameter g1 as described above. (m2) is, desirably, a value which varies each of the reverberation control circuits 250 and the second generators 256 but may be the same value in each of the reverberation control circuits 250 or in each of the second generators 256.

The second reverberation component generated by the second generator 256 like in the first generator 255 is set so that as the parameter $\alpha$ increases, the reverberation time increases and, as the parameter $\alpha$ decreases, the reverberation time decreases as shown by Equation (5). The feedback reverberation component output from the component mix adjuster 258 and having the predetermined delay time is a reverberation component in which the first and second reverberation components are mixed as will be described later.

When one signal component in the audio signal or test signal is input to the reverberation control circuit 250, the first reverberation component output from the first generator 255 and the second reverberation component output from the second generator 256 are input to the component mix adjuster 258. The component mix adjuster 258 generates a feedback reverberation component on the basis of the input first and second reverberation components, and outputs or feeds back the generated feedback reverberation component to the first generator 255 and the second generator 256.

For example, the component mix adjuster 258 computes Equation (6) using the input first and second reverberation components, thereby mixing the first and second reverberation components, and outputs the reverberation component generated by using the determinant of Equation (6) as a feedback reverberation component to the first and second generators 255 and 256.

$$(B_1,B_2)=(\text{first reverberation component, second reverberation component})A \qquad \text{Equation (6)}$$

where $B_1$ and $B_2$ denote feedback reverberation components. The component mix adjuster 258 feeds back the first feedback reverberation component $B_1$ to the first generator 255 and feeds back the second feedback reverberation component $B_2$ to the second generator 256. The matrix A shown in Equation (6) is expressed by Equation (7), and is a unitary matrix.

$$A = U = \frac{1}{\sqrt{2}}\begin{pmatrix} 1 & 1 \\ -1 & 1 \end{pmatrix} \qquad \text{Equation (7)}$$

When the matrix A is a unitary matrix ($A^{-1}=A^T$), the conditions of g1<1 and g2<1 are satisfied and the feedback circuit of the reverberation component generating unit 252 is stabilized.

When one signal component in the audio signal or test signal is input to the reverberation control circuit 250, the first reverberation component output from the first generator 255 and the second reverberation component output from the second generator 256 are input to the first adder 257. The first adder 257 adds the input first and second reverberation components, thereby generating one reverberation component, and outputs the generated reverberation component to the second adder 259.

When one signal component in the audio signal or test signal is input to the reverberation control circuit 250, the reverberation component output from the first adder 257 and a signal component directly output from the distributor 254 are input to the second adder 259. The second adder 259 adds the input reverberation component to the signal component, thereby generating a signal component to which the reverberation component is added, and outputs the generated signal component to which the reverberation component is added to the frequency synthesizer 253.

The second adder 259 multiplies the generated signal component to which the reverberation component is added with a predetermined coefficient, that is, adjusts the gain, thereby performing energy control in the frequency band.

When one signal component in the audio signal or test signal is input to the reverberation control circuit 250, the signal component to which the reverberation component generated by the reverberation component generating unit 252 is added is input to the frequency synthesizer 253. The frequency synthesizer 253 combines the input signal components to which the reverberation components are added, thereby regenerating the audio signal or test signal of the channel, and outputs the regenerated signal to each of the corresponding D/A converters 122.

With such a configuration, the reverberation component generating unit 252 of the embodiment generates and adds the reverberation component in each of the frequency bands. For example, when the audio signal or test signal is input to the reverberation component generating unit 252, reverberation components having different delay times and different attenuation ratios are generated in the first and second generators 255 and 256 and are mixed in the component mix adjuster 258. In addition, reverberation components having different delay times and different attenuation ratios are generated in the first and second generators 255 and 256, and the reverberation components attenuate gradually. By adding the generated reverberation component to the original signal component, the reverberation component of the signal component can be adjusted.

In the reverberation component generating unit 252 of the embodiment, a feedback Delay Network (FDN) is constructed by the first generator 255, the second generator 256, and the component mix adjuster 258, and the reverberation component generating unit 252 of the embodiment generates a reverberation component by using the feedback delay network.

Figure 8:
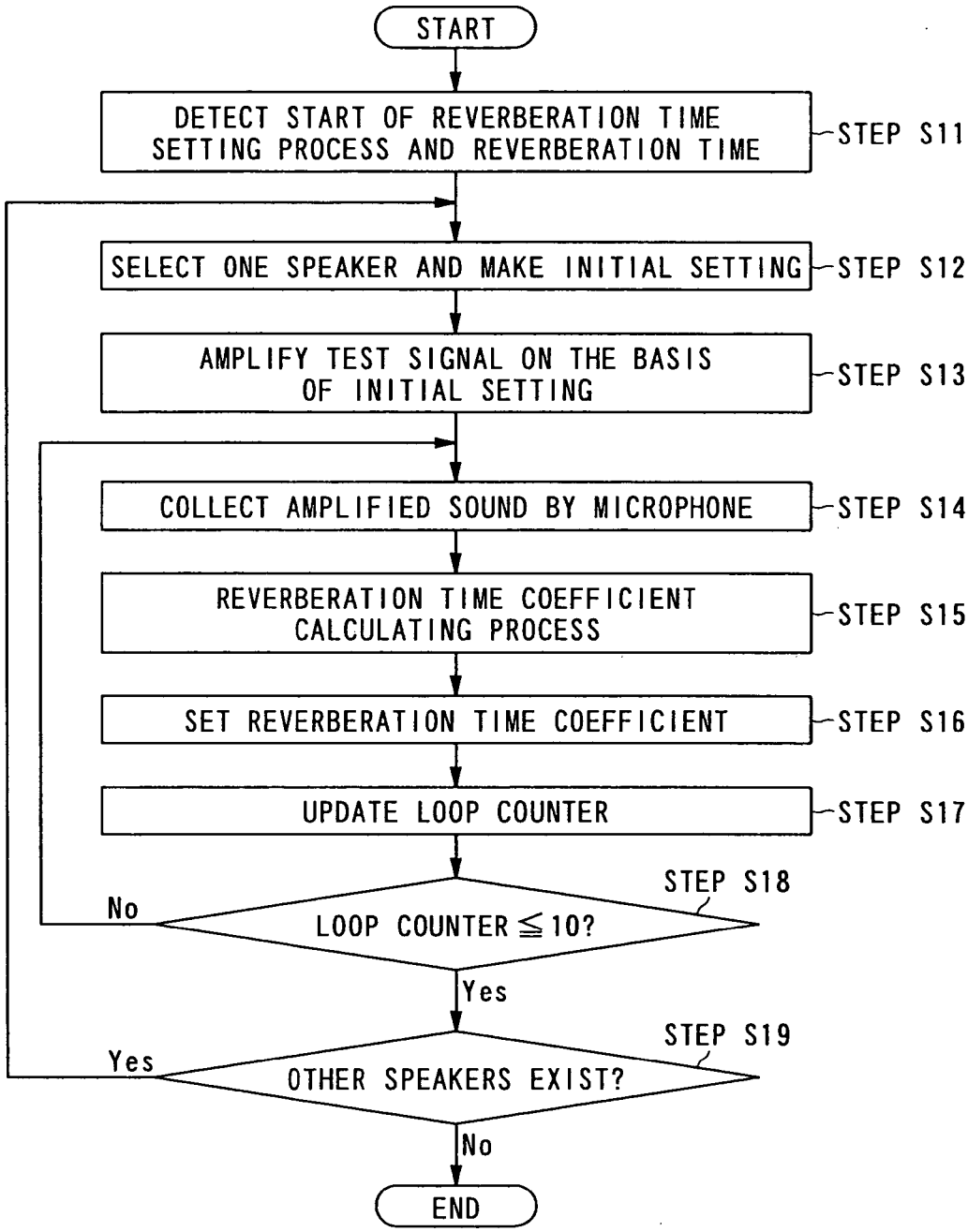
FIG. 8 is a flowchart showing operations of reverberation control coefficient setting process in a system controller in the first embodiment.

Next, the operations of the reverberation control coefficient setting process including the reverberation parameter calculating process in the system controller 129 of the embodiment will be described with reference to FIG. 8. FIG. 8 is a flowchart showing the operations of the reverberation control coefficient setting process in the system controller 129 of the embodiment.

It is assumed that the microphone 140 is already set in the listening position of the user and is connected to the signal processing apparatus 120. In the operation, it is assumed that the reverberation control coefficient setting process is performed on the basis of reverberation time set by the user, that is, target reverberation time, and the reverberation time range used for the reverberation parameter calculating process is preset to 0 ms to 500 ms.

First, an instruction to start the reverberation control coefficient setting process for setting reverberation time and reverberation time desired by the user as target reverberation time are input by the user to the system controller 129 via the operating unit 128, and the system controller 129 detects the instruction and the input target reverberation time (step S11) The system controller 129 selects one speaker in which reverberation time has not been set, and makes initial settings of parameters $\alpha$ in the reverberation control coefficient setting process, the other parameters, and a loop counter used at the time of performing the reverberation parameter calculating process in the reverberation control coefficient setting process (step S12).

At this time, the system controller 129 determines a reverberation parameter based on the reverberation time as an initial value in the reverberation characteristic analyzer 127C, and controls the signal process controller 260 to calculate the reverberation control coefficient on the basis of the reverberation parameter. The system controller 129 makes each reverberation control circuit 250 set each of the reverberation control coefficients calculated by the signal process controller 260, and makes the test signal generator 124 generate a test signal.

For example, in the embodiment, the system controller 129 makes the signal process controller 260 calculate each of reverberation control coefficients g1 and g2 to allow the reverberation control circuit 250 to generate the reverberation time in the center of the reverberation time range, for example, 250 ms on the basis of the reverberation parameter. The system controller 129 makes each of the reverberation control circuits 250 set each of the calculated reverberation control coefficients g1 and g2.

The system controller 129 makes the test signal generator 124 generate a test signal on the basis of the initial setting and controls the signal process controller 260 to start amplifying the test signal and output the amplified signal from a selected speaker, for example, the center speaker 131 (step S13).

Specifically, the system controller 129 controls the signal process controller 260 to stop outputting operation of not-selected other speakers by stopping outputting of the signal level in the power amplifier 123 or inhibiting input in the signal processor 200, and to start outputting the amplified test signal from the selected speaker.

When the test signal is amplified and the amplified test signal is output from the selected center speaker 131, the microphone 140 collects the amplified sound from the center speaker 131, and outputs the collected amplified sound as a sound-collected signal to the spatial characteristic analyzer 127 via the A/D converter 126 (step S14).

Subsequently, when the sound-collected signal is input to the spatial characteristic analyzer 127, the system controller 129 calculates reverberation time in the spatial characteristic analyzer 127 in each of the predetermined frequency bands as described above, allows the reverberation parameter to be calculated in each of the predetermined frequency bands from the calculated reverberation time and the target reverberation time set by the user, and allows each of the calculated reverberation parameters to be output as data to the signal process controller 260 (reverberation parameter calculating process (step S15)).

Subsequently, the system controller 129 calculates, in each of the frequency bands, the reverberation control coefficients in each of the first and second generators 255 and in the reverberation control circuit 250 corresponding to a channel on the basis of the reverberation parameter in each of the frequency bands input to the signal process controller 260, that is, a channel in which the test signal is amplified. The system controller 129 sets the calculated reverberation control coefficients in the first and second generators 255 and 256 (step S16).

Then the system controller 129 adds "1" to the loop counter to update the loop counter (step S17), and determines whether or not the value in the loop counter is larger than a preset value, for example, "10" or lager (step S18). In the case where the value of the loop counter is "10" or smaller, the system controller 129 shifts to the process of step S14. In the case where the value of the loop counter is larger than "10", the system controller 129 shifts to a process of step S19.

After that, the system controller 129 determines whether or not there is a speaker in which the reverberation time has not been set yet, that is, the reverberation control coefficient has not been set yet (step S19). When there is a speaker in which the reverberation control coefficient has not been set, the system controller 129 moves to the process in step S12. When there is no speaker in which the reverberation control coefficient has not been set, that is, in the case where the reverberation time has been set in all of the speakers, the operation is finished.

Figure 9:
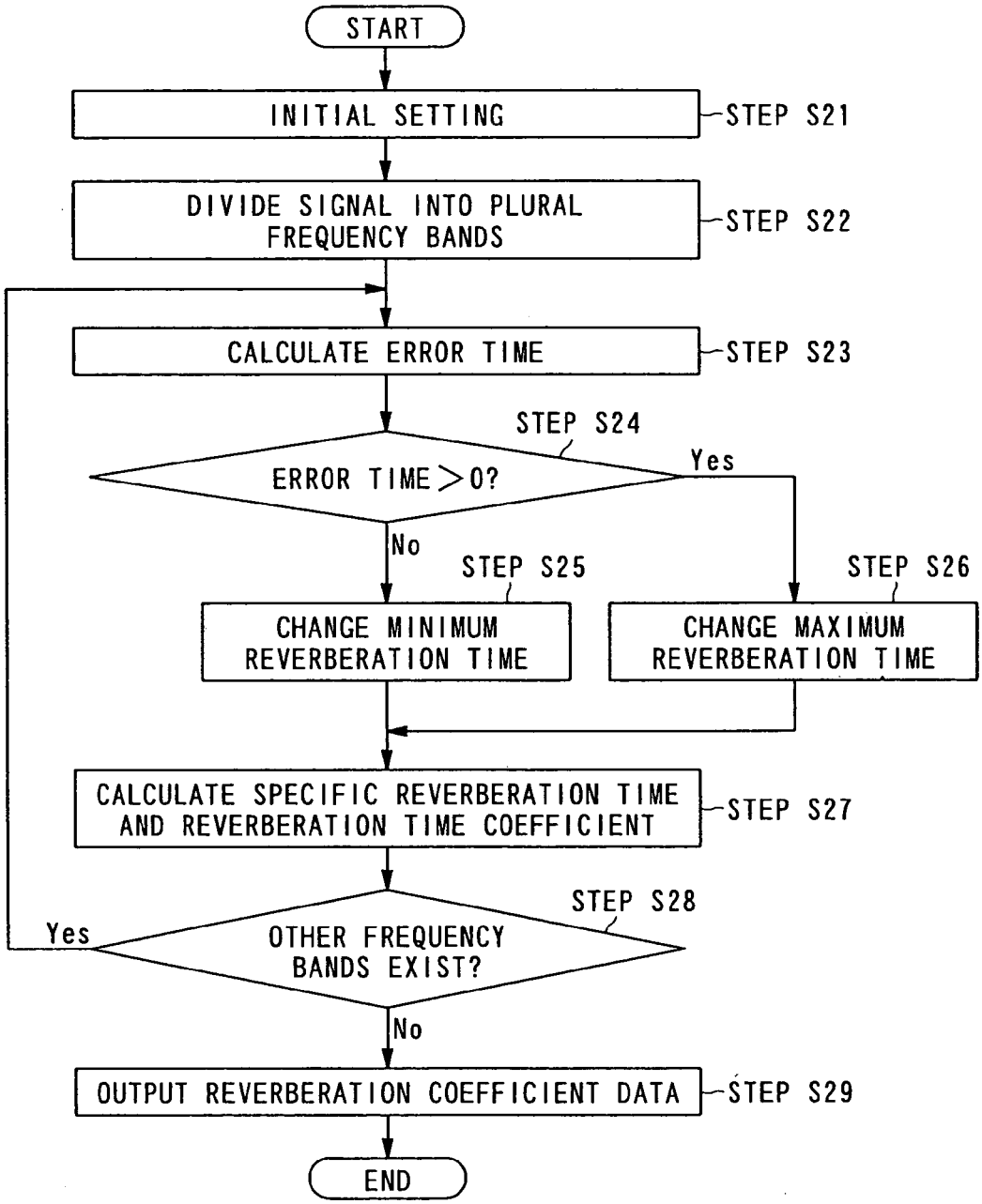
FIG. 9 is a flowchart showing operations of the reverberation parameter calculating process in the system controller in the first embodiment.

Next, the operation of the reverberation time setting coefficient calculating process in the system controller 129 of the embodiment will be described with reference to FIG. 9. FIG. 9 is a flowchart showing the operations of the reverberation parameter calculating process in the system controller 129 of the embodiment. In the operation, it is assumed that the predetermined number of frequency bands (the number of bands) is "6", and the reverberation control coefficient is calculated in the order from the low frequency band.

First, the system controller 129 initializes parameters used in the reverberation parameter calculating process (step S21). Specifically, the system controller 129 initializes a band counter for determining a frequency band in which the reverberation control coefficient is calculated.

After that, the system controller 129 makes the reverberation characteristic analyzer 127C divide the sound-collected signal in the test signal into a plurality of signal components in respective frequency bands (step S22) and execute the following process in the order from the low frequency band.

The system controller 129 makes the reverberation characteristic analyzer 127C calculate reverberation time in each of the frequency bands on the basis of the sound-collected signal in the test signal and calculate error time by comparing calculated reverberation time in the corresponding frequency band and target reverberation time as the reverberation time input by the user (step S23). Specifically, as described above, the system controller 129 makes the reverberation characteristic analyzer 127C calculate the reverberation time and subtract the calculated reverberation time from the target reverberation time, thereby calculating error time.

Subsequently, the system controller 129 makes the reverberation characteristic analyzer 127C calculate the reverberation parameter on the basis of the calculated error time (steps S24 to S27). Specifically, the system controller 129 makes the reverberation characteristic analyzer 127C determine whether or not the calculated error time is larger than "0" (step S24). When the reverberation characteristic analyzer 127C determines that the calculated error time is "0" or smaller, as described above, the system controller 129 makes the reverberation characteristic analyzer 127C change the minimum reverberation time in the reverberation time range on the basis of Equation (1) (step S25). When the reverberation characteristic analyzer 127C determines that the calculated error time is larger than "0", as described above, the system controller 129 makes the reverberation characteristic analyzer 127C change the maximum reverberation time in the reverberation time range on the basis of Equation (3) (step S26). As described above, the system controller 129 makes the reverberation characteristic analyzer 127C calculate specific reverberation time by using Equation (2) on the basis of the minimum reverberation time and the maximum reverberation time in the reverberation time range, and calculates a reverberation parameter on the basis of the calculated specific reverberation time (step S27).

Subsequently, the system controller 129 makes the reverberation characteristic analyzer 127C determine whether or not there is a frequency band in which the reverberation parameter has not been calculated (step S28). Specifically, the system controller 129 adds "1" to the band counter and determines whether or not the incremented value of the band counter is the same as the number of the plurality of frequency bands divided, that is, the number of bands. When the value of the band counter is smaller than the number of bands, the system controller 129 moves to the process in step S23. When the value of the band counter is equal to the number of bands, the system controller 129 moves to the process in step S29.

Finally, the system controller 129 makes the reverberation characteristic analyzer 127C output, as data, the calculated reverberation parameter in each of the frequency bands to the signal processor 200 (step S29), and finish the operation.

As described above, the surround system 100 of the embodiment has: the speaker system 130 disposed in the listening room 10 and amplifying sound; the signal processing apparatus for adjusting a reverberation component in the sound source on the basis of the reverberation characteristic of the listening room 10 and the speaker system 130 amplifying the sound source; and the microphone 140 for collecting the amplified sound in a specific listening position in the listening room when the amplified sound is output from the speaker system 130 to the listening room 10. The signal processing apparatus 120 has: the input processor 121 for obtaining an audio signal as sound; the test signal generator 124 for generating a test signal used for analyzing a reverberation characteristic of the listening room 10 as the sound source; the power amplifier 123 for amplifying at least one of the audio signal and the test signal and outputting the amplified signal from the speaker system 130; the spatial characteristic analyzer 127 for obtaining amplified sound indicative of amplified sound collected by the microphone 140, recognizing a reverberation characteristic with respect to time of the listening room 10 on the intensity of sound in the listening position of the amplified sound signal on the basis of the obtained amplified sound, and calculating rate of change indicative of attenuation time in the listening position of the amplified sound and the degree of change in the intensity level of the amplified sound on the basis of the recognized reverberation characteristic; and the signal processor 200 for adjusting the reverberation characteristic of the test signal to be amplified and output to the speaker system 130 on the basis of the calculated rate of change, and adjusting the reverberation characteristic of the audio signal obtained as the sound source and to be amplified and output from the speaker system 130 on the basis of the reverberation characteristic adjusted on the test signal.

With the configuration, the surround system 100 of the embodiment recognizes the reverberation characteristic with respect to time on the intensity of sound in the listening position of the amplified sound signal on the basis of the obtained amplified sound, and calculates rate of change indicative of attenuation time in the listening position of the amplified sound and the degree of change in the intensity level of the amplified sound on the basis of the recognized reverberation characteristic. The surround system 100 adjusts the reverberation characteristic of an audio signal obtained on the basis of the calculated rate of change or a generated test signal.

Therefore, the surround system 100 of the embodiment can adjust the reverberation characteristic on the basis of reverberation time in the listening position and the intensity level, so that the reverberation component in the audio signal can be adjusted easily and accurately.

In other words, in the case of adjusting the reverberation component in the audio signal, special knowledge is necessary and, in the case of using the FIR filter, a number of parameters such as the filter factor have to be set. In particular, in the case where the user sets desired reverberation time by operating the operating unit 128 as described above, to make the reverberation times in the respective frequency bands uniform, a number of parameters have to be set, and the setting operation of each parameter is troublesome. However, in the surround system 100 of the embodiment, the reverberation time can be adjusted only with the reverberation parameter $\alpha$.

As a result, in the surround system 100 of the embodiment, operability of the user is improved, the reverberation time, that is, the reverberation characteristic of the amplified sound can be accurately set, and a sound field in which an audio signal can be amplified naturally without making the user feel strange at the time of adjusting the reverberation time can be provided.

In the surround system 100 of the embodiment, when the reverberation characteristic of the test signal generated by the signal processor 200 is adjusted and the adjusted test signal is sequentially output to the speaker system 130, the spatial characteristic analyzer 127 sequentially calculates the reverberation time on the basis of the obtained amplified sound, and the signal processor 200 adjusts the reverberation characteristic of the test signal to be amplified and output to the speaker system 130 each time the reverberation parameter is calculated.

With the configuration, the surround system 100 of the embodiment sequentially calculates the rate of change on the basis of the obtained amplified sound and, each time the reverberation time is calculated, adjusts the reverberation characteristic of a test signal to be amplified and output to the speaker system 130.

Therefore, in the surround system 100 of the embodiment, by repeating measurement of the reverberation characteristic with the test signal and calculation of the reverberation parameter, measurement and evaluation of the reverberation characteristic of the sound field space can be repeatedly performed. Thus, adjustment of the reverberation characteristic, that is, setting of the reverberation time can be performed accurately at the time of amplifying the audio signal.

The surround system 100 of the embodiment further includes the operating unit 128 used for setting the attenuation time in a target amplified sound. The signal processor 200 adjusts the reverberation characteristic in a test signal generated by the test signal generator 124 on the basis of recognized attenuation time and the set attenuation time.

With the configuration, the surround system 100 of the embodiment adjusts the reverberation characteristic in a test signal generated by the test signal generator 124 on the basis of recognized attenuation time and the set attenuation time. Thus, adjustment of the reverberation characteristic, that is, setting of the reverberation time at the time of amplifying the audio signal on the basis of the attenuation time desired by the user can be performed accurately.

In the surround system 100 of the embodiment, the spatial characteristic analyzer 127 recognizes, as the attenuation characteristic, reverberation time indicative of attenuation time in which intensity level of sound in the listening position is attenuated from the initial value to a predetermined value on the basis of the obtained amplified sound signal.

With the configuration, the surround system 100 of the embodiment can recognize the reverberation characteristic of the sound field space on the basis of the reverberation time simply expressing the reverberation characteristic. By using the reverberation time at the time of adjusting the reverberation characteristic of the listening room 10, the reverberation characteristic of the listening room 10 can be adjusted accurately and easily.

In the surround system 100 of the embodiment, the spatial characteristic analyzer 127 calculates rate of change in the attenuation time of the amplified sound and the intensity level of the sound by using a logarithmic function.

With the configuration, the surround system 100 of the embodiment calculates rate of change in the attenuation time of the amplified sound and the intensity level of the sound by using a logarithmic function. Thus, the reverberation time can be calculated easily and accurately, and the load on the surround system can be reduced.

In the surround system 100 of the embodiment, the signal processor 200 includes: the first generator 255, the second generator 256, and the component mix adjuster 258 for generating a reverberation component in at least one of the obtained audio signal and the generated test signal on the basis of the obtained reverberation parameter, and adjusting the reverberation characteristic of at least one of the audio signal and the test signal by adding the generated reverberation component to the original signal from which the reverberation component is generated.

With the configuration, the surround system 100 of the embodiment generates a reverberation component in the audio signal obtained on the basis of the calculated rate of change or the generated test signal, and adjusts the reverberation characteristic of the audio signal or the test signal by adding the generated reverberation component to the original signal from which the reverberation component is generated.

Therefore, the surround system 100 of the embodiment can easily generate the reverberation component on the basis of the reverberation parameter, and a sound field in which an audio signal can be amplified naturally without making the user feel strange at the time of adjusting the reverberation time can be provided.

In the surround system 100 of the embodiment, the first generator 255, the second generator 256, and the component mix adjuster 258 generate the reverberation component of the sound source while adjusting time density of a reverberation component generated on the basis of a predetermined coefficient.

With the configuration, the surround system 100 of the embodiment can stabilize the system and add the reverberation component easily and accurately.

In the surround system 100 of the embodiment, the first generator 255, the second generator 256, and the component mix adjuster 258 generate a reverberation component of sound by using an FDN (Feedback Delay Network).

With the configuration, the surround system 100 of the embodiment can stabilize the system and add the reverberation component easily and accurately.

In the surround system 100 of the embodiment, the spatial characteristic analyzer 127 and the signal processor 200 perform recognition of the attenuation characteristic, calculation of a reverberation parameter, and adjustment of the reverberation characteristic of the listening room 10 in each of predetermined frequency bands.

With the configuration, the surround system 100 of the embodiment can accurately add the reverberation component, so that a sound field in which an audio signal can be amplified naturally without making the user feel strange at the time of adjusting the reverberation time can be provided.

In the embodiment, the reverberation parameter calculating process is performed in each of the channels and each of the preset frequency bands, and the reverberation time coefficient is set in each of the frequency bands in the reverberation control circuit 250. It is also possible to calculate the reverberation parameter in the preset frequency bands in the full frequency range for each of the channels without dividing into each of the preset frequency bands, calculate the reverberation control coefficient on the basis of the calculated reverberation parameter, and set the calculated reverberation control coefficient in the reverberation control circuit 250 of each channel.

In the embodiment, the reverberation parameter calculating process is performed in each of the channels, and the reverberation time coefficient is set in each of the frequency bands in the reverberation control circuit 250. It is also possible to calculate the reverberation parameter in all of the channels in a lump or calculate only one reverberation parameter in all of the channels.

In the embodiment, each of the reverberation control circuits 250 mixes reverberation components in two paths and generates the reverberation component on the basis of the reverberation control coefficient data. The reverberation control circuit 250 may generate a reverberation component by using one path or three or more paths.

In the embodiment, each of the reverberation control circuits 250 generates a reverberation component in each of the predetermined frequency bands. The reverberation control circuit 250 may also generate the reverberation component without dividing the input audio signal or test signal in a plurality of frequency bands.

In this case, each of the reverberation control circuits 250 may be provided with the reverberation component generating unit 252 for generating and adding a reverberation component in the full frequency range of the audio signal or test signal. Alternatively, by cascading the reverberation component generating units 252 for generating the reverberation components in each of the predetermined frequency bands, the reverberation component may be generated.

In the embodiment, each of the reverberation control circuits 250 mixes reverberation components in two paths and generates the reverberation component on the basis of the reverberation control coefficient data. It is however sufficient to generate delay time of a reverberation component to be generated by using reverberation control coefficient data, and the reverberation component can be generated by a method other than the above-described method.

In the foregoing embodiment, the process of setting the reverberation time by using the 5.1 ch surround system 100 is described. Obviously, the invention can be also applied to other sound reproducing apparatuses such as a stereo sound reproducing apparatus like a 7.1 ch surround system, or an AV amplifier.

In the embodiment, the signal processing apparatus 120 performs addition of a reverberation component and the other signal processes on the basis of an output digital signal in the sound source output apparatus 110. Obviously, the signal processing apparatus 120 may perform a signal process on the basis of an analog signal output from the sound source output apparatus 110 or an analog signal supplied from the outside.

In the embodiment, in each of the reverberation control circuits 250, the audio signal or test signal is divided into a plurality of components in each of the preset frequency bands, and a reverberation component is generated and added to each of the divided signal components. However, the audio signal or test signal may not be divided into a plurality of components in each of the frequency bands but a reverberation component may be generated and added to each of signals in the channels.

Although the reverberation control coefficient setting process including the reverberation parameter calculating process is performed by the signal processing apparatus 120 in the embodiment, it is also possible to provide the signal processing apparatus 120 with a computer and a recording medium, store a program for executing the reverberation control coefficient setting process including the reverberation parameter calculating process on the recording medium, and read the program by the computer to perform the reverberation control coefficient setting process including the reverberation parameter calculating process.

Second Embodiment

A second embodiment of a surround system according to the present invention will be described with reference to FIGS. 10 to 12.

The second embodiment is characterized by, in place of a point that a reverberation component is generated and added by performing a predetermined computation on the basis of a calculated reverberation control coefficient (rate of change indicative of attenuation time and the degree of change in the intensity level) in each of the reverberation control circuits in the first embodiment, a point such that a reverberation component is generated and added by using a table for holding values corresponding to the reverberation control coefficients. The other configuration of the second embodiment is similar to that of the first embodiment, so that the same reference numerals are designated to the same members and their description will be omitted.

Specifically, the signal process controller of the second embodiment holds, as coefficient data, reverberation control coefficients corresponding to the gradient of an approximate linear line indicative of the reverberation characteristic of the listening room 10 calculated by the spatial characteristic analyzer or reverberation time indicated by the gradient, reads the coefficient data on the basis of the gradient of the approximate linear line or the data of reverberation time (hereinafter, referred to as reverberation time data) RT supplied via the system controller, and sets the coefficient data read by the reverberation component generating unit.

Each of the reverberation control circuits of the embodiment generates and adds a reverberation component to a corresponding signal component in an input audio signal or test signal on the basis of the coefficient data set by the signal process controller.

First, the configuration and operation of each of the reverberation control circuits of the second embodiment will be described with reference to FIGS. 10 and 11. FIG. 10 is a block diagram showing the configuration of the reverberation control circuit in the signal processor in the second embodiment. FIG. 11 is a diagram for explaining reverberation components generated in the reverberation control circuit.

Figure 10:
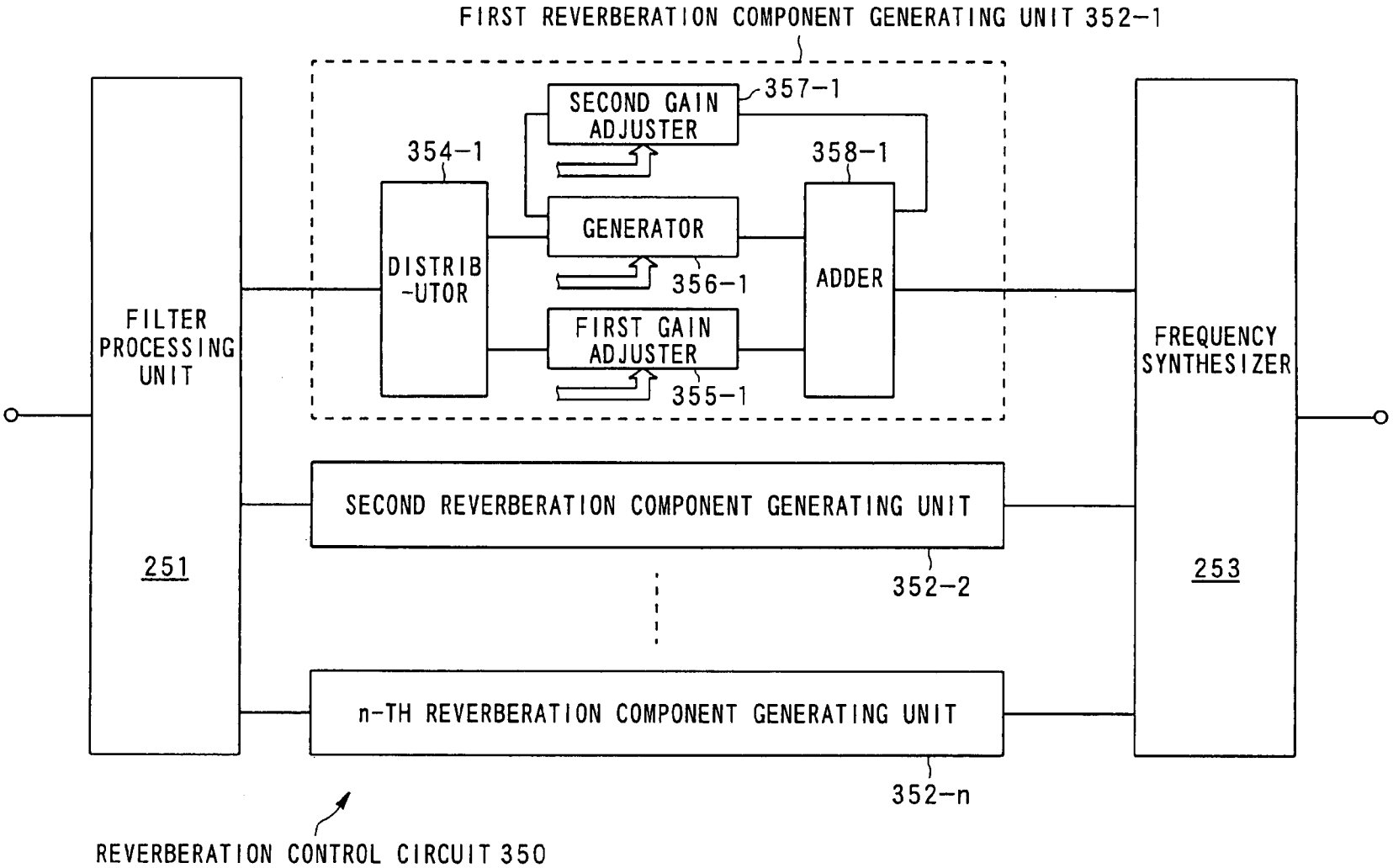
FIG. 10 is a block diagram showing the configuration of the reverberation control circuit in the signal processing unit in a surround system of a second embodiment according to the invention.
Figure 11:
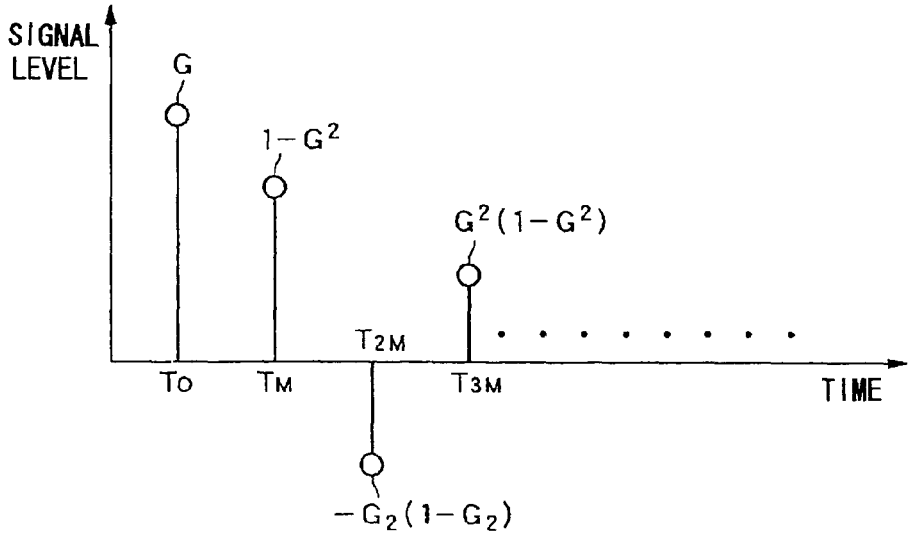
FIG. 11 is a diagram for explaining reverberant components generated in the reverberant control circuit of the second embodiment.

A reverberation control circuit 350 of the second embodiment has, as shown in FIG. 10, the filter processing unit 251, a reverberation component generating unit 352 in which coefficient data is set by the signal process controller 260 at the time of the reverberation control coefficient setting process, and which generates the reverberation component for each of the frequency bands divided on the basis of the set coefficient data when an audio signal or test signal is input, and adds the generated reverberation component to the input original audio signal or test signal, and the frequency synthesizer 253.

The coefficient data set in the reverberation component generating unit 352 is set for each of the channels and each of the frequencies in a manner similar to the first embodiment.

Each of the reverberation component generating units 352 of the embodiment has: a distributor 354, when an audio signal or test signal is input, for dividing the input audio signal or test signal to a plurality of frequency band components which are preliminarily determined for the respective frequency bands; a first gain adjuster 355 for adjusting the gain on the basis of the coefficient data set for one signal component distributed; a generator 356 in which coefficient data is set at the time of performing the reverberation control coefficient setting process and, when an audio signal or test signal is input, which generates a reverberation component for one of the components distributed on the basis of the set coefficient data; an adder 358 for adding the generated reverberation component and a signal component whose gain is adjusted in the case where the audio signal or test signal is input; and a second gain adjuster 357 for adjusting the gain on the basis of coefficient data set for the signal component to which the reverberation component is added, and feeding back the resultant data to the generator 356.

When one signal component in the audio signal or test signal is input to the reverberation control circuit 350, the corresponding one signal component output from the filter processing unit is input to the distributors 354. Each of the distributors 354 distributes the input signal component to the first gain adjuster 355 and the generator 356.

Specifically, when one signal component in the audio signal or test signal is input to the reverberation control circuit 350, each of the distributors 354 distributes the input signal component and outputs it to the generator 356 and the first gain adjuster 355 respectively.

In the first gain adjuster 355, when the reverberation control coefficient setting process is executed, coefficient data corresponding to the frequency band in the reverberation control circuit 350 is set by the signal process controller 260. For example, in the second embodiment, a coefficient (hereinafter, referred to as gain coefficient) G indicated by the coefficient data is set in a memory (not shown) provided on the inside of the generator 356.

When one signal component in the audio signal or test signal is input to the reverberation control circuit 350, one signal component is input to the first gain adjuster 355. The first gain adjuster 355 adjusts the gain of one signal component input on the basis of the set gain coefficient G, and outputs the signal component whose gain has been adjusted to the adder 358.

In the generator 356, when the reverberation control coefficient setting process is executed, coefficient data corresponding to the frequency band in the reverberation control circuit 350 is set by the signal process controller 260. For example, in the embodiment, a coefficient (hereinafter, referred to as delay coefficient) M indicated by coefficient data in a memory (not shown) provided on the inside of the generator 356 is set.

When one signal component in the audio signal or test signal is input to the reverberation control circuit 350, the signal component output from the distributor 354 and a reverberation component fed back via the second gain adjuster 357 as will be described later are input to the generator 356. The generator 356 adds the feedback reverberation component to the input signal component, generates a reverberation component having delay time "M" in the added signal component on the basis of the set delay coefficient "M", and outputs the generated reverberation component to the adder 358.

To the adder 358, the gain-adjusted signal component and the reverberation component area input. The adder 358 adds the reverberation component to the input signal component, outputs the signal component to which the reverberation component is added to the frequency synthesizer, and outputs the signal component to the second gain adjuster 357.

In the second gain adjuster 357, when the reverberation control coefficient setting process is executed, coefficient data corresponding to the frequency band in the reverberation control circuit 350 is set by the signal process controller 260. For example, in the embodiment, a gain coefficient −G indicated by the coefficient data is set in a memory (not shown) provided on the inside of the generator 356. In the second gain adjuster 357, the gain coefficient of the coefficient −G whose sign is different from the first gain coefficient G is set.

When one signal component in the audio signal or test signal is input to the reverberation control circuit 350, one signal component is input to the second gain adjuster 357. The second gain adjuster 357 adjusts the gain of the input one signal component on the basis of the coefficient indicated by the set coefficient data, and feeds back the signal component whose gain is adjusted to the generator 356.

With such a configuration, the reverberation component generating unit 352 of the embodiment generates and adds the reverberation component for each of the frequency bands. For example, when a unit signal of "1" is input to the reverberation component generating unit 352, as shown in FIG. 11, a reverberation component which is gradually attenuated can be generated each delay time "M", and the generated reverberation component can be sequentially added to the signal component. In FIG. 11, T0 indicates time in which the unit signal is input, TM, T2M, and T3M indicate time of each delay time "M", and values shown in the diagram indicate signal levels of the reverberation components which are output with respect to the input signal.

First, the configuration and operation of the signal process controller 260 in the second embodiment will be described with reference to FIG. 12. FIG. 12 is a diagram showing a data structure held in a table provided for the signal process controller 260 in the second embodiment.

To the signal process controller 260 of the second embodiment, an approximate linear line of the reverberation characteristic calculated in the reverberation characteristic analyzer 127C or reverberation time indicated by the approximate linear line is input as reverberation time data (RT). In the signal process controller 260, a table for holding coefficient data corresponding to the reverberation time data (RT) is held. The signal process controller 260 reads coefficient data to be set on the basis of the reverberation time data (RT), which is input, and the read coefficient data, is set in each of the reverberation component generating units 352 in the reverberation control circuits 350.

Specifically, the gain coefficient and the delay coefficient for each frequency band to be associated by the reverberation time data (RT) are held in the signal process controller 260 of the embodiment. The signal process controller 260 reads the gain coefficient and the delay coefficient of each corresponding frequency band on the basis of the input reverberation time data (RT) under control of the system controller 129, and sets the read gain coefficients and delay coefficients in the generator 356, the first gain adjuster 355, and the second gain adjuster 357 provided for each frequency in each reverberation control circuit 350.

For example, in the signal process controller 260 of the second embodiment, as shown in FIG. 12, for each reverberation control coefficient $\alpha$, the gain coefficient G and the delay coefficient M are held in each of six bands, that is, frequency bands using, as the center frequency, 500 Hz, 1 kHz, 2 kHz, 4 kHz, 8 kHz, and 16 kHz.

In the process of setting the reverberation time in the second embodiment, in place of the operation of step S16 in the reverberation time setting process in the first embodiment, the reverberation time is set on the basis of the input reverberation time data (RT) in the generator 356, the first gain adjuster 355, and the second gain adjuster 357 provided for each frequency. The other processes are similar to those of the first embodiment (refer to FIG. 8).

Specifically, the signal process controller 260 reads the gain coefficient and the delay coefficient in a corresponding frequency band on the basis of the input reverberation time data (RT) under control of the system controller 129, and sets the read gain coefficient and delay coefficient in the generator 356, the first gain adjuster 353, and the second gain adjuster 357 provided for each of the frequencies in each reverberation control circuit 350.

As described above, the surround system 100 of the embodiment has: the speaker system 130 disposed in the listening room 10 and amplifying sound; the signal processing apparatus 120 for adjusting a reverberation component in the sound on the basis of the reverberation characteristic of the listening room 10 and amplifying the sound by the speaker system 130; and the microphone 140 for collecting the amplified sound in a specific listening position in the listening room 10 when the amplified sound is output from the speaker system 130 to the listening room 10. The signal processing apparatus 120 has: the input processor 121 for obtaining an audio signal as sound; the test signal generator 124 for generating a test signal used for analyzing a reverberation characteristic of the listening room 10 as the sound source; the power amplifier 123 for amplifying at least one of the audio signal and the test signal and outputting the amplified signal from the speaker system 130; the spatial characteristic analyzer 127 for obtaining amplified sound indicative of amplified sound collected by the microphone 140, recognizing a reverberation characteristic with respect to time of the listening room 10 on the intensity of sound in the listening position of the amplified sound signal on the basis of the obtained amplified sound, and calculating rate of change indicative of attenuation time in the listening position of the amplified sound and the degree of change in the intensity level of the amplified sound on the basis of the recognized reverberation characteristic; and the signal processor 200 for adjusting the reverberation characteristic of the test signal to be amplified and output to the speaker system 130 on the basis of the calculated rate of change, and adjusting the reverberation characteristic of the audio signal obtained as the sound source and to be amplified and output from the speaker system 130 on the basis of the reverberation characteristic adjusted on the test signal.

With the configuration, the surround system 100 of the embodiment recognizes the reverberation characteristic with respect to time on the intensity of sound in the listening position of the amplified sound signal on the basis of the obtained amplified sound, and calculates rate of change indicative of attenuation time in the listening position of the amplified sound and the degree of change in the intensity level of the amplified sound on the basis of the recognized reverberation characteristic. The surround system 100 adjusts the reverberation characteristic of an audio signal obtained on the basis of the calculated rate of change or a generated test signal.

Therefore, the surround system 100 of the embodiment can adjust the reverberation characteristic on the basis of reverberation time in the listening position and the intensity level, so that the reverberation component in the audio signal can be adjusted easily and accurately.

In other words, in the case of adjusting the reverberation component in the audio signal, special knowledge is necessary and, in the case of using the FIR filter, a number of parameters such as the filter factor have to be set. In particular, in the case where the user sets desired reverberation time by operating the operating unit 128 as described above, to make the reverberation times in the respective frequency bands uniform, a number of parameters have to be set, and the parameter setting operation is troublesome. However, in the surround system 100 of the embodiment, the reverberation time can be adjusted only by the reverberation time data (RT).

As a result, in the surround system 100 of the embodiment, operability of the user is improved, the reverberation time, that is, the reverberation characteristic of the amplified sound can be accurately set, and a sound field in which an audio signal can be amplified naturally without making the user feel strange at the time of adjusting the reverberation time can be provided.

In the second embodiment, the reverberation control coefficient calculating process is performed in each of the channels and each of the preset frequency bands, and the reverberation control coefficient is set in each of the frequency bands in the reverberation control circuit 350. It is also possible to calculate the reverberation control coefficient not in the preset frequency bands but in the full frequency range for each of the channels and set the calculated reverberation control coefficient as the reverberation control coefficient in the reverberation control circuit 350 of each channel.

In the second embodiment, the reverberation control coefficient calculating process is performed channel by channel, and the reverberation time coefficient is set in each of the frequency bands in the reverberation control circuit 350. It is also possible to calculate the reverberation control coefficient in all of the channels in a lump or calculate only one reverberation control coefficient in all of the channels.

In the second embodiment, each of the reverberation control circuits 350 mixes reverberation components in two paths and generates the reverberation component on the basis of the reverberation control coefficient data. The reverberation control circuit 350 may generate a reverberation component by using one path or three or more paths.

In the second embodiment, each of the reverberation control circuits 350 generates a reverberation component in each of the predetermined frequency bands. The reverberation control circuit 350 may also generate the reverberation component without dividing the input audio signal or test signal in a plurality of frequency bands.

In this case, each of the reverberation control circuits 350 may be provided with the reverberation component generating unit 352 for generating and adding a reverberation component in the full frequency range of the audio signal or test signal. Alternatively, by cascading the reverberation component generating units 352 for generating the reverberation components in each of the predetermined frequency bands, the reverberation component may be generated.

In the second embodiment, the process of setting the reverberation time by using the 5.1 ch surround system 100 is described. Obviously, the invention can be also applied to other sound reproducing apparatuses such as a stereo sound reproducing apparatus like a 7.1 ch surround system, or an AV amplifier.

In the second embodiment, the signal processing apparatus 120 performs addition of a reverberation component and the other signal processes on the basis of an output digital signal in the sound source output apparatus 110. Obviously, the signal processing apparatus 120 may perform a signal process on the basis of an analog signal output from the sound source output apparatus 110 or an analog signal supplied from the outside.

In the second embodiment, the reverberation control coefficient setting process including the reverberation control coefficient calculating process is performed by the above-described signal processing apparatus. It is also possible to provide the signal processing apparatus with a computer and a recording medium, store a program for executing the reverberation control coefficient setting process including the reverberation control coefficient calculating process on the recording medium, and read the program by the computer to perform the reverberation control coefficient setting process including the reverberation control coefficient calculating process.

The invention claimed is:

1. A reverberation adjusting apparatus for adjusting a reverberation component of a sound source which is output from a speaker on the basis of a reverberation characteristic of a sound field space in which the sound source is amplified by a speaker, comprising:

a first obtaining device which obtains a sound signal as the sound source;

a generating device which generates a test signal used for analyzing a reverberation characteristic of the sound field space as the sound source;

an output control device which amplifies at least one of the sound signal and the test signal and outputs the amplified signal from the speaker;

a second obtaining device, when the test signal is amplified and the amplified signal is output from the speaker to the sound field space, which obtains an amplified sound signal indicative of amplified sound in a specific listening position in the sound field space;

a recognizing device which recognizes an attenuation characteristic indicative of attenuation with time of the sound field space with respect to the intensity of sound in the listening position of the amplified sound signal on the basis of the obtained amplified sound signal;

a calculating device which calculates reverberation time in the listening position of the amplified sound on the basis of the recognized attenuation characteristic; and an operating device used for setting target reverberation time in the amplified sound;

an adjusting device which adjusts an attenuation characteristic of the test signal to be amplified and output to the speaker on the basis of the calculated reverberation time and the set target reverberation time, wherein the adjusting device which generates a reverberation component in at least one of the obtained sound signal and the generated test signal on the basis of rate of change indicative of the degree of change in the intensity level of attenuation characteristic corresponding to the reverberation time of the test signal one-to-one, and adjusts an attenuation characteristic of at least one of the sound signal and the test signal by adding the generated reverberation component to the original signal from which the reverberation component is generated so that the reverberation time in the listening position is equal to the set target reverberation time.

2. The reverberation adjusting apparatus according to claim 1, wherein in the case where the attenuation characteristic of the generated test signal is adjusted by the adjusting device and the adjusted test signals are sequentially output to the speaker, the calculating device sequentially calculates the rate of change on the basis of the amplified sound signal obtained by the second obtaining device, and the adjusting device adjusts the attenuation characteristic of the test signal to be amplified and output to the speaker each time the rate of change is calculated.

3. The reverberation adjusting apparatus according to claim 1, wherein the recognizing device recognizes, as the attenuation characteristic, reverberation time indicative of attenuation time in which intensity level of sound in the listening position is attenuated from the initial value to a predetermined value on the basis of the obtained amplified sound signal.

4. The reverberation adjusting apparatus according to claim 1, wherein the calculating device calculates rate of change in the attenuation time of the amplified sound and the intensity level of the sound by using a logarithmic function.

5. The reverberation adjusting apparatus according to claim 1, wherein the generating device generates the reverberation component of the sound while adjusting time density of a reverberation component generated on the basis of a predetermined coefficient.

6. The reverberation adjusting apparatus according to claim 1, wherein the generating device generates a reverberation component of the sound by using an FDN (Feedback Delay Network).

7. The reverberation adjusting apparatus according to claim 1, wherein the recognizing device, the calculating device, and the adjusting device perform recognition of the attenuation characteristic, calculating of the rate of change, and adjustment of the attenuation characteristic of the sound source, respectively, in each of predetermined frequency bands.

8. A reverberation adjusting method of adjusting a reverberation component of a sound source output from a speaker on the basis of a reverberation characteristic of a sound field space in which the sound source is amplified by the speaker, comprising:

a first obtaining process of obtaining a sound signal as the sound source;

a generating process of generating a test signal used for analyzing a reverberation characteristic of the sound field space as the sound source;

an output control process of amplifying at least one of the sound signal and the test signal and outputting the amplified signal from the speaker;

a second obtaining process, when the test signal is amplified and the amplified signal is output from the speaker to the sound field space, for obtaining an amplified sound signal indicative of amplified sound in a specific listening position in the sound field space;

a recognizing process of recognizing an attenuation characteristic indicative of attenuation with time of the sound field space of intensity of sound in the listening position of the amplified sound signal on the basis of the obtained amplified sound signal;

a calculating process of calculating reverberation time in the listening position of the amplified sound level-on the basis of the recognized attenuation characteristic;

an operating process of setting target reverberation time in the amplified sound;

an adjusting process of adjusting an attenuation characteristic of the test signal to be amplified and output to the speaker on the basis of the calculated reverberation time and the set target reverberation time, wherein, in the adjusting process, a reverberation component in at least one of the obtained sound signal and the generated test signal are generated on the basis of rate of change indicative of the degree of change in the intensity level of attenuation characteristic corresponding to the reverberation time of the test signal one-to-one, and an attenuation characteristic of at least one of the sound signal and the test signal are adjusted by adding the generated reverberation component to the original signal from which the reverberation component is generated so that the reverberation time in the listening position is equal to the set target reverberation time.

9. A sound field correcting system for amplifying a sound source by a speaker which is set in a sound field space, comprising:

a sound reproducing apparatus for adjusting a reverberation component of the sound source on the basis of a reverberation characteristic of the sound field space and amplifying the sound source by the speaker; and a sound collecting device which collects the amplified sound in a specific listening position in the sound field space when amplified sound is output from the speaker to the sound field space, wherein the sound reproducing apparatus comprises:

a first obtaining device which obtains a sound signal as the sound source;

a generating device which generates a test signal used for analyzing a reverberation characteristic of the sound field space as the sound source;

an output control device which amplifies at least one of the sound signal and the test signal and outputs the amplified signal from the speaker;

a second obtaining device which obtains an amplified sound signal indicative of amplified sound collected by the sound collecting device;

a recognizing device which recognizes an attenuation characteristic indicative of attenuation with time of the sound field space with respect to the intensity of sound in the listening position of the amplified sound signal on the basis of the obtained amplified sound signal;

a calculating device which calculates reverberation time in the listening position of the amplified sound and the degree of change in the intensity level on the basis of the recognized attenuation characteristic; and an operating device used for setting reverberation time in the amplified sound;

an adjusting device which adjusts an attenuation characteristic of the test signal to be amplified and output to the speaker on the basis of the calculated reverberation time and the set target reverberation time, wherein, the adjusting device which generates a reverberation component in at least one of the obtained sound signal and the generated test signal on the basis of rate of change indicative of the degree of change in the intensity level of attenuation characteristic corresponding to the reverberation time of the test signal one-to-one, and adjusts an attenuation characteristic of at least one of the sound signal and the test signal by adding the generated reverberation component to the original signal from which the reverberation component is generated so that the reverberation time in the listening position is equal to the set target reverberation time.

* * * * *